US006276677B1

(12) United States Patent
Hommochi et al.

(10) Patent No.: US 6,276,677 B1
(45) Date of Patent: Aug. 21, 2001

(54) SHEET BUNDLE FOLDING APPARATUS WITH MOVABLE PUSH-IN MEMBER

(75) Inventors: Hiroki Hommochi, Tokyo; Seiichiro Adachi, Abiko, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/215,158

(22) Filed: Dec. 18, 1998

(30) Foreign Application Priority Data

Dec. 27, 1997 (JP) ..... 9-369092

(51) Int. Cl.[7] ..... B65H 45/16

(52) U.S. Cl. ..... 270/32; 270/37; 493/494; 493/445; 493/446

(58) Field of Search ..... 270/32; 493/37, 493/494, 445, 446

(56) References Cited

U.S. PATENT DOCUMENTS 5,169,376 * 12/1992 Ries et al. ..... 493/445
5,546,168 8/1996 Adachi et al. ..... 355/233
5,700,002 12/1997 Kato et al. ..... 270/58.12
5,738,620 * 4/1998 Ebner et al. ..... 493/445
6,022,011 * 2/2000 Hirose ..... 270/37

* cited by examiner

*Primary Examiner*—Christoper P. Ellis
*Assistant Examiner*—Patrick Mackey
(74) *Attorney, Agent, or Firm*—Fitzpatrick, Cella, Harper & Scinto

(57) ABSTRACT

In a sheet bundle folding apparatus for folding a bundle of sheets in two, a stick-out plate for sticking the bundle of sheets is adapted to reliably stick the bundle of sheets folded while being held between rollers for folding the bundle of sheets in a folding position therefor. A first folding roller is positionally fixed. A second folding roller is movable toward and away from the first folding roller. The stick-out plate sticks the bundle of sheets and pushes it into between the first and second folding rollers. At this time, the rollers of the stick-out plate roll along a groove. The forward roller is fitted in the groove with a correction allowance above it, and is downwardly biased by a spring. The stick-out plate follows the folding position for the bundle of sheets.

6 Claims, 19 Drawing Sheets

| |
|---|
| FIG. 10A |
| FIG. 10B |

STACK MODE

SHEET BUNDLE FOLDING APPARATUS WITH MOVABLE PUSH-IN MEMBER

BACKGROUND OF THE INVENTION

1. Field of the Invention

This invention relates to a sheet bundle folding apparatus.

This sheet bundle folding apparatus is used when for example, in an image forming apparatus such as a copying apparatus, a bundle of sheets on which image formation has been effected is to be folded in two.

2. Related Background Art

There are already known various sheet treating apparatuses for effecting the post-treatment of sheets on which image formation has been effected by an image forming apparatus such as a copying apparatus.

One of these sheet treating apparatuses binds a bundle of a predetermined number of sheets and folds the bound bundle of sheets in two.

FIG. 17 of the accompanying drawings shows the construction of a sheet treating apparatus 200 according to the prior art which effects the binding and folding work.

A sheet bundle folding apparatus for folding a bundle of sheets in two is constituted by a sheet binding device 18 for binding a bundle of sheets, folding rollers 26 and 27 and a stick-out unit 25.

A sheet on which image formation has been done discharged from an image forming apparatus, not shown, is carried into the sheet treating apparatus 200.

The sheet thus carried in is conveyed by a convey roller 17 and passes by the sheet binding device 18 and is delivered to a convey roller 22, and is conveyed until the leading end edge thereof arrives at a sheet stopper 23 waiting at a first stacking position. Then, the widthwise end portions of the sheet are trued up by sheet aligning means 24 and alignment is effected.

A similar operation is repeated for a plurality of sheets, and the plurality of sheets (a bundle of sheets) are stacked at the first stacking position. The stacked bundle of sheets are bound by the sheet binding device 18.

Thereafter, a sheet stopper 23 is moved to a second stacking position, where the bundle of sheets are folded in two. The bound bundle of sheets are stuck by the stick-out unit 25, whereby they are directed to the nip portion between the folding rollers 26 and 27 and are folded in two by the folding rollers 26 and 27, whereafter they are discharged onto a stacking tray 32 outside the apparatus by a pair of discharge rollers 30 and 31.

One folding roller 26 is movable in a direction of escape (upwardly) by an amount corresponding to the thickness of the bundle of sheets to hold the bundle of sheets between it and the other folding roller 27. As shown in FIG. 18 of the accompanying drawings, the folding roller 26 is mounted on a holding plate 98 supported on a frame 8 (FIG. 17) for pivotal movement about a support shaft 98*a*, and is urged against the folding roller 27 mounted (fixedly) also on the frame 8, by a spring 99.

The stick-out unit 25 is designed to be moved along a groove 8*a* formed in the frame 8, stick out the bundle of sheet by a stick-out plate 25*a* at the end thereof, and direct the bundle of sheet to the nip between the folding rollers 26 and 27.

However, the above-described sheet bundle folding apparatus according to the prior art has suffered from the inconvenience that the stick-out unit 25 cannot accurately stick the bundle of sheets in a folding position therefor.

That is, the sticking position of the stick-out unit 25 is fixed at the nip position between the rollers 26 and 27 when the upper folding roller 26 is in contact with the lower folding roller 27. The stick-out unit 25 is moved along the groove 8*a* so as to stick the bundle of sheets at the same nip position.

In contrast, the folding position for the bundle of sheets changes before and after the upper folding roller 26 separates from the lower folding roller 27.

The folding position for the bundle of sheets before the upper folding roller separates from the lower folding roller is the nip position between the two rollers 26 and 27 and at this time, the folding position for the bundle of sheets and the sticking position of the stick-out unit 25 are coincident with each other. However, the folding position for the bundle of sheets after the upper folding roller has separated from the lower folding roller deviates from the folding position before the upper folding roller separates from the lower folding roller and correspondingly, a deviation occurs between the actual folding position for the bundle of sheets and the sticking position of the stick-out unit 25.

This has led to the possibility that the stick-out unit 25 cannot accurately the bundle of sheets in the folding position and wrinkles or breakage may occur to the sheets.

SUMMARY OF THE INVENTION

So, the present invention has been made in view of the circumstances as described above and the object thereof is to provide a sheet bundle folding apparatus designed to accurately stick a bundle of sheet in a folding position therefor so as not to cause the wrinkles or breakage of the sheets.

To achieve the above object, the present invention relates to a sheet bundle folding apparatus provided with a fixed folding member fixed at a predetermined position, a movable folding member movable toward and away from the fixed folding member, and a sheet bundle push-in member movable toward between the fixed folding member and the movable folding member to push a bundle of sheet into between the fixed folding member and the movable folding member.

To achieve the above object, the present invention is characterized in that the sheet bundle push-in member is designed to follow the folding position for the bundle of sheet pushed into between the fixed folding member and the movable folding member by the sheet bundle push-in member.

DESCRIPTION OF THE PREFERRED EMBODIMENTS

Some embodiments of the present invention will hereinafter be described with reference to the drawings.

First Embodiment

Figure 1:
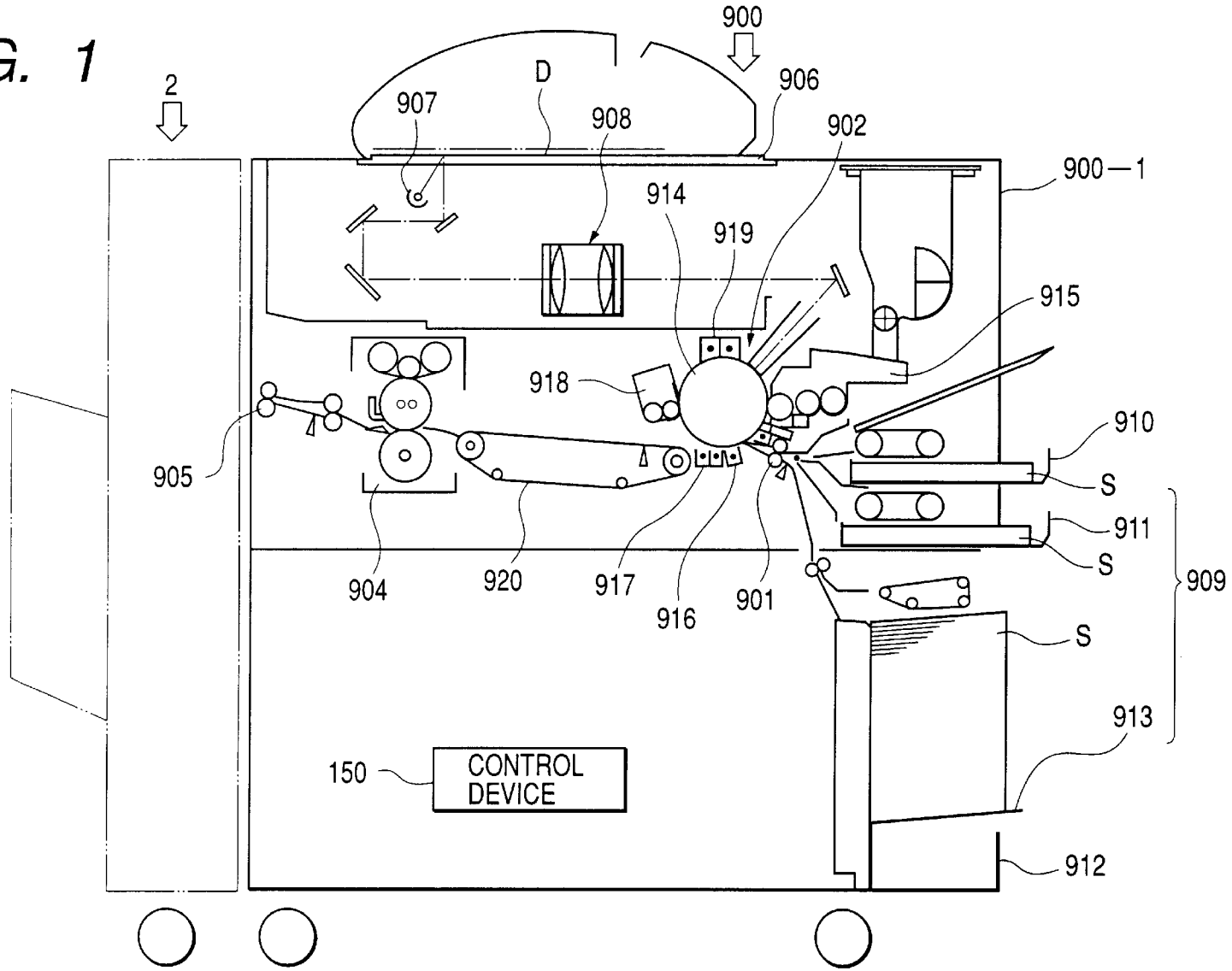
FIG. 1 is a longitudinal cross-sectional view showing the general construction of an image forming apparatus provided with a sheet treating apparatus.

FIG. 1 shows the general construction of an image forming apparatus (copying apparatus) provided with a sheet treating apparatus 2.

Figure 2:
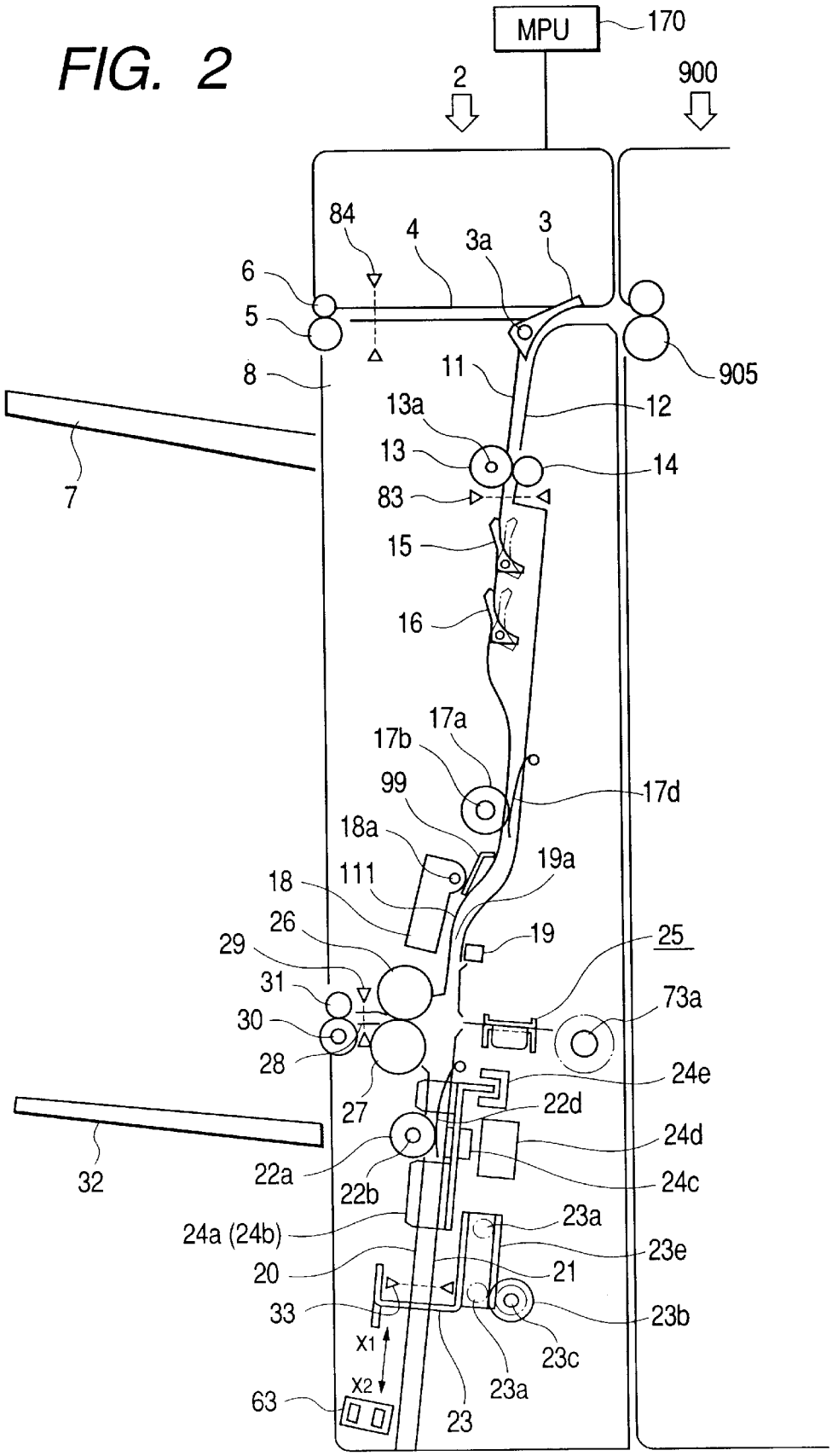
FIG. 2 is a longitudinal cross-sectional view showing the general construction of a sheet treating apparatus provided with the sheet bundle folding apparatus of the present invention.

The sheet treating apparatus 2 effects the work of binding and folding a bundle of sheets on which image formation has been done by the image forming apparatus 900 in two. The present invention is applied to a sheet bundle folding apparatus for folding the bundle of sheets in two. FIG. 2 shows the construction of the sheet treating apparatus 2.

The epitome of the image forming apparatus 900 will first be described.

The image forming apparatus 900 is provided with platen glass 906 as an original supporting table, a light source 907 a lens system 908, a paper supplying portion 909, an image forming portion 902, etc.

The paper supplying portion 909 has cassettes 910 and 911 containing bundles of sheets S for recording therein and removably mountable on an apparatus body 900-1, and a deck 913 disposed on a pedestal 912.

The image forming portion 902 is provided with a cylindrical photosensitive drum 914 and a developing device 915, a charger 916 for transfer, a separating charger 917, a cleaner 918, a primary charger 919, etc. around the photosensitive drum 914.

A conveying device 920, a fixating device 904, a pair of discharge rollers 905, etc. are disposed downstream of the image forming portion 902.

The operation of the image forming apparatus 900 will now be described.

When a paper supply signal is outputted from a control device 150 provided on the apparatus body 900-1 side, a sheet S is fed from the cassette 910 or 911 or the deck 913.

On the other hand, light applied from a light source 907 to an original D placed on an original supporting table 906 and reflected therefrom is applied onto the photosensitive drum 914 through the lens system 908.

The photosensitive drum 914 is charged in advance by the primary charger 919 and the light is applied thereto, whereby an electrostatic latent image is formed thereon, and then the electrostatic latent image is developed by the developing device 915 to thereby form a toner image.

The sheet S fed from the paper supplying portion 909 has its skew feeding corrected by a pair of register rollers 901 and is further timed and sent to the image forming portion 902.

In the image forming portion 902, the toner image on the photosensitive drum 914 is transferred to the sheet S sent thereto by the charger 916 for transfer, and the sheet S having the toner image transferred thereto is charged to a polarity opposite to that of the charger 916 for transfer by the separating charger 917 and is separated from the photosensitive drum 914.

Then, the separated sheet S is conveyed to the fixating device 904 by the conveying device 920, and the transferred image is permanently fixated on the sheet S by the fixating device 904.

The sheet S having the image fixated thereon is discharged from the apparatus body 900-1 by the pair of discharge rollers 905.

Figure 3:
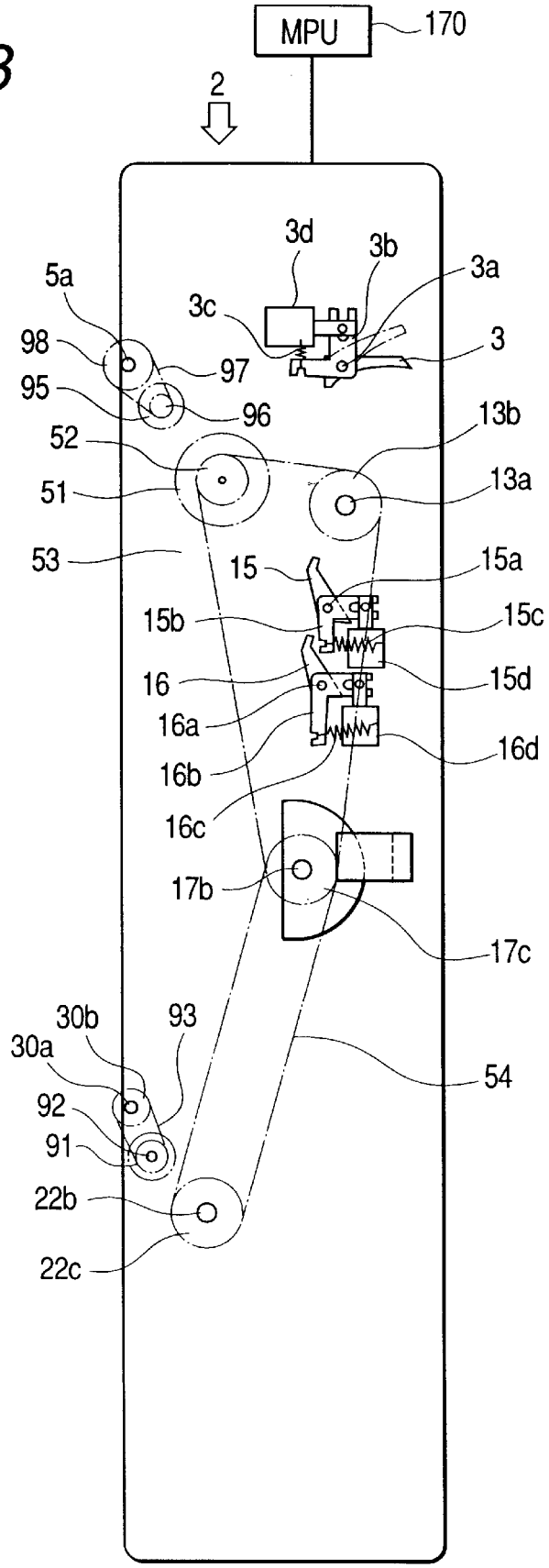
FIG. 3 is a side view showing the construction of a driving system in the sheet treating apparatus of FIG. 2.

The sheet treating apparatus 2 shown in FIG. 2 will now be described with reference to FIG. 3.

The reference numeral 3 designates an inlet flapper which is engaged with an inlet solenoid 3*d*, and the changeover of the bookbinding mode/the stack mode is effected by the ON/OFF of the power source of the inlet solenoid 3*d*.

[Construction of Stack Mode]

A stacker discharge roller 5 and a stacker discharge roller 6 are disposed downstream of a paper discharge guide 4.

A stacker tray 7 is provided for stacking thereon sheets discharged by the stacker discharge roller 5.

When the stack mode is selected by the sheet treating apparatus 2, an image is formed by the image forming apparatus 900, and the discharged sheets are directed to the guide 4 by the flapper 3, are discharged onto the stacker tray 7 by the discharge roller 5 and the discharge roller 6 and are stacked thereon.

[Bookbinding Mode Construction]

The reference numerals 11 and 12 denote guides. The reference numeral 13 designates a first convey roller, and a convey roller 14 is disposed in opposed relationship with the first convey roller 13 and is urged against the first convey roller 13.

The reference numerals 15 and 16 designate upper and lower switching flappers, respectively.

Switching solenoids 15*d* and 16*d* are engaged with the switching flappers 15 and 16, respectively, and the switching flappers are designed to assume two positions indicated by dot-and-dash lines and solid line by being put ON and OFF by an electrical signal.

Resilient members (contacting means) 17*d* and 22*d* for binding the sheet into contact with second convey rollers 17*a* and 22*a* are disposed in opposed relationship with the second convey rollers 17*a* and 22*a*, respectively, and are urged against the convey rollers 17*a* and 22*a*, respectively.

The convey rollers 17*a* and 22*a* receive and further convey the sheet sent by the convey roller 13, and are stopped when the arrival of the leading end edge of the sheet at a leading end edge stopper 23 is detected by a sensor 33 which will be described later.

The reference numeral 18 denotes a staple unit which will be described later. The staple unit 18 is for staple-binding a bundle of sheets.

Guides 20 and 21 are disposed downstream of the staple unit 18.

Width adjusting members (aligning means) 24*a* and 24*b* are for holding down the sheet from opposite sides and aligning the sheet.

A leading end edge stopper (positioning means) 23 are a member for receiving the leading end edge of the bundle of sheets which has come into between the guides 20 and 21. This stopper 23 is movable in the directions of arrows X1 and X2, in FIG. 2, between the guides 20 and 21.

The leading end edge stopper 23 has two purposes, i.e., the positioning when stapling by the staple unit 18, and the positioning of fold which will be described later. A leading end edge stopper sensor 33 for detecting the leading end edge of the bundle of sheets is disposed on the leading end edge stopper 23.

A sheet folding device comprising folding rollers 26 and 27 (movable and fixed folding members) and a stick-out unit 25 is disposed between the staple unit 18 and the leading end edge stopper 23.

The stick-out unit 25 is retracted outwardly from the guides 12 and 21 before folding is effected. The folding rollers 26 and 27 are urged against each other.

A discharge guide 28 is for guiding the bundle of sheets discharged from the folding rollers 26 and 27 to the nip between a discharge roller 30 and a roller 31.

A discharge sensor 29 detects the leading end and trailing end of the bundle of sheets conveyed while being folded by the folding rollers 26 and 27.

A stacking tray 32 stacks on its substantially horizontal stacking surface the bundle of sheets discharged by the discharge roller 30 and the discharge roller 31.

[Inlet Flapper Driving Mechanism]

The inlet flapper 3 is pivotally movable about a central shaft 3*a*. A link 3*b* is secured to one end of the central shaft 3*a*. A spring 3*c* is engaged with the link 3*b* and biases the flapper in one direction. One end of the link 3*b* is engaged with the inlet solenoid 3*d*.

When the power source of the inlet solenoid 3*d* is turned on, the solenoid 3*d* attracts an iron core and the flapper 3 jumps up and changes over to the bookbinding mode. When the power source is OFF, the flapper assumes the stack mode and guides the bundle of sheet toward the guide 4.

[Convey Roller Driving Mechanism]

A convey roller pulley 13*b* is secured to the central shaft 13*a* of the convey roller 13. A convey roller pulley 17*c* is secured to the central shaft 17*b* of the convey roller 17*a*. A convey roller pulley 22*c* is secured to the central shaft 22*b* of the convey roller 22*a*.

A convey motor pulley 52 is secured to the output shaft of a convey motor 51. A timing belt 53 is wound around the convey motor pulley 52, the convey roller pulley 13*b* and the convey roller pulley 17*c*. Also, a timing belt 54 is wound between the convey roller pulleys 17*c* and 22*c*.

The rotation of the convey motor 51 is transmitted from the convey motor pulley 52 to the timing belt 53, rotates the convey roller pulleys 13*b* and 17*c* and further rotates the convey roller pulley 22*c* through the timing belt 54 to thereby rotate the convey rollers 13, 17*a* and 22*a*. In this case, the convey roller pulleys 17*c* and 22*c* are rotated in synchronism with each other and therefore, the convey rollers 17*a* and 22*a* are also rotated in synchronism with each other.

[Switching Flapper Driving Mechanism]

Flapper links 15*b* and 16*b* are secured to the central shafts 15*a* and 16*a*, respectively, of the switching flappers 15 and 16. One end of the flapper links is engaged with the switching solenoids 15*d* and 16*d*.

Springs 15*c* and 16*c* are engaged with the other ends of the flapper links 15*b* and 16*b* and hold the switching flappers 15 and 16 in their positions indicated by solid lines. When the power source of the switching solenoids 15*d* and 16*d* is turned on, the switching solenoids attract iron cores and change over the switching flappers 15 and 16 to their positions of dot-and-dash lines (FIG. 2).

The switching flappers 15 and 16 are changed over depending on the size of the sheets treated by the sheet treating apparatus 2 so that the order in which bundles of sheets stacked and aligned in the present apparatus are stacked may always be constant, that is, so that the sheets stacked later may always be stacked leftwardly upwardly of the bundles.

[Width Adjusting Mechanism]

Figure 4:
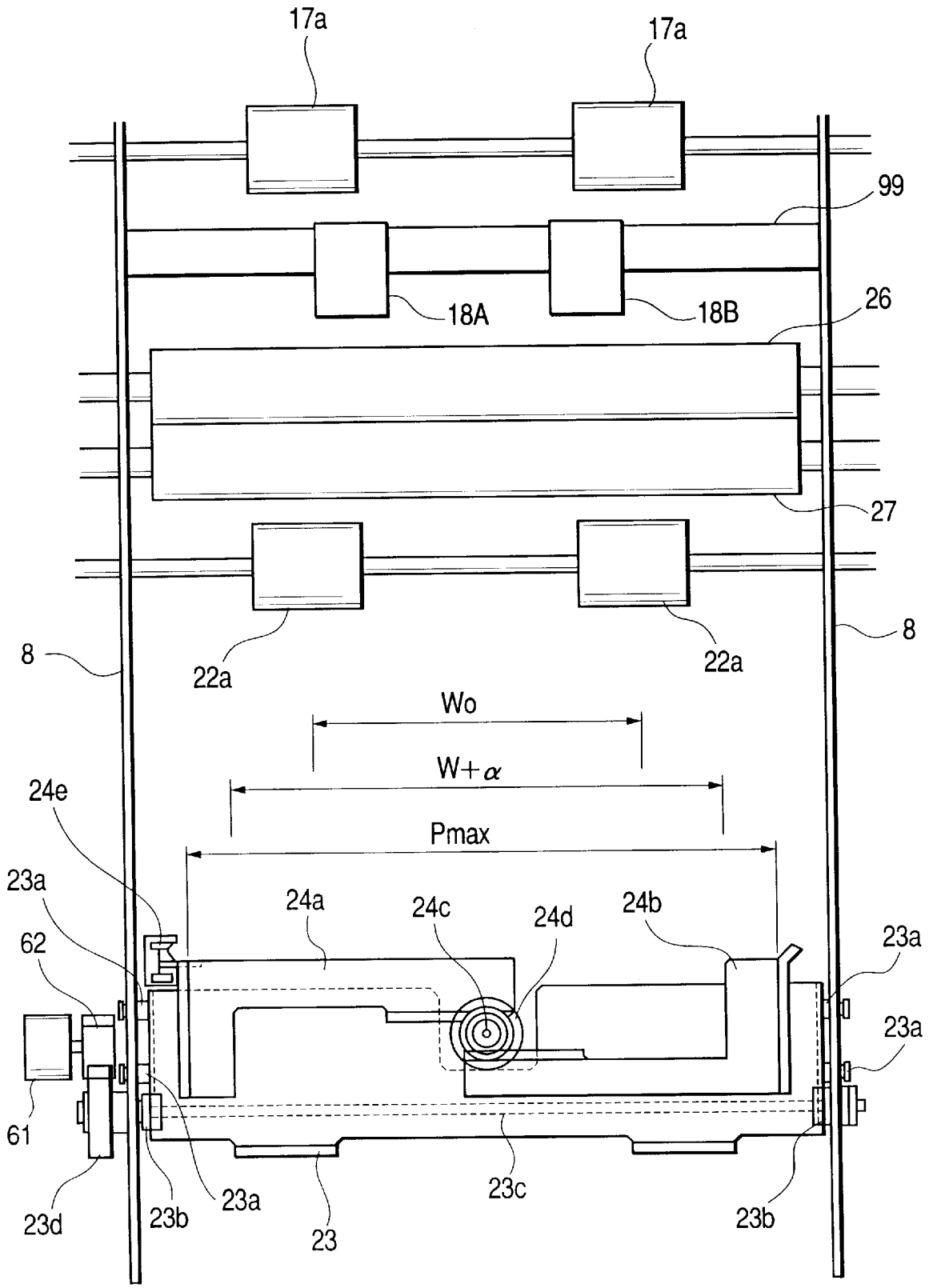
FIG. 4 is a transverse cross-sectional view showing the constructions of a width adjusting mechanism, a stopper driving mechanism, etc. in the sheet treating apparatus of FIG. 2.

A width adjusting mechanism will now be described with reference to FIG. 4, etc.

Width adjusting members (aligning means) 24*a* and 24*b* disposed forwardly and rearwardly of the apparatus body have wall surfaces horizontal with respect to the direction of conveyance of the bundle of sheets and vertical with respect to the opposite sides of the bundle of sheets, and are formed with rack portions in the central portions thereof. A pinion gear 24*c* is engaged with the racks.

The reference character 24*d* designates a width adjusting motor comprised of a stepping motor, and the pinion gear 24*c* is secured to the output shaft thereof.

A width adjusting home sensor 24*e* is comprised of a photointerrupter. The width adjusting home sensor 24*e* is disposed at a position for detecting a flag formed on a portion of the width adjusting member 24*a* when the width adjusting members 24*a* and 24*b* are retracted by a predetermined amount outwardly of the width of the largest bundle of sheets that can be aligned.

The width adjusting members 24*a* and 24*b* are driven by the width adjusting motor 24*d* and align the sheets carried into the stopper 23.

[Stopper Driving Mechanism]

A stopper driving mechanism will now be described with reference to FIG. 4, etc.

A roller 23*a* is rotatably mounted on the stopper 23 and slides in groove portions formed in frames 8. Racks 23*e* are provided on the opposite ends of the stopper 23. Pinion gears 23*b* are in meshing engagement with the racks 23*e*.

Drive is transmitted to the pinion gears 23*b* through a shaft 23*c*. A stopper gear 23*d* is secured to one end of the shaft 23*c*.

A stopper motor 61 is comprised of a stepping motor. A gear 62 is secured to the output shaft of the stopper motor 61 and is in meshing engagement with the stopper gear 23*d*.

A flag is formed on a portion of the stopper 23, and is detected by a stopper home sensor 63 when it has arrived at the home position.

[Staple Unit Driving Mechanism]

Figure 5:
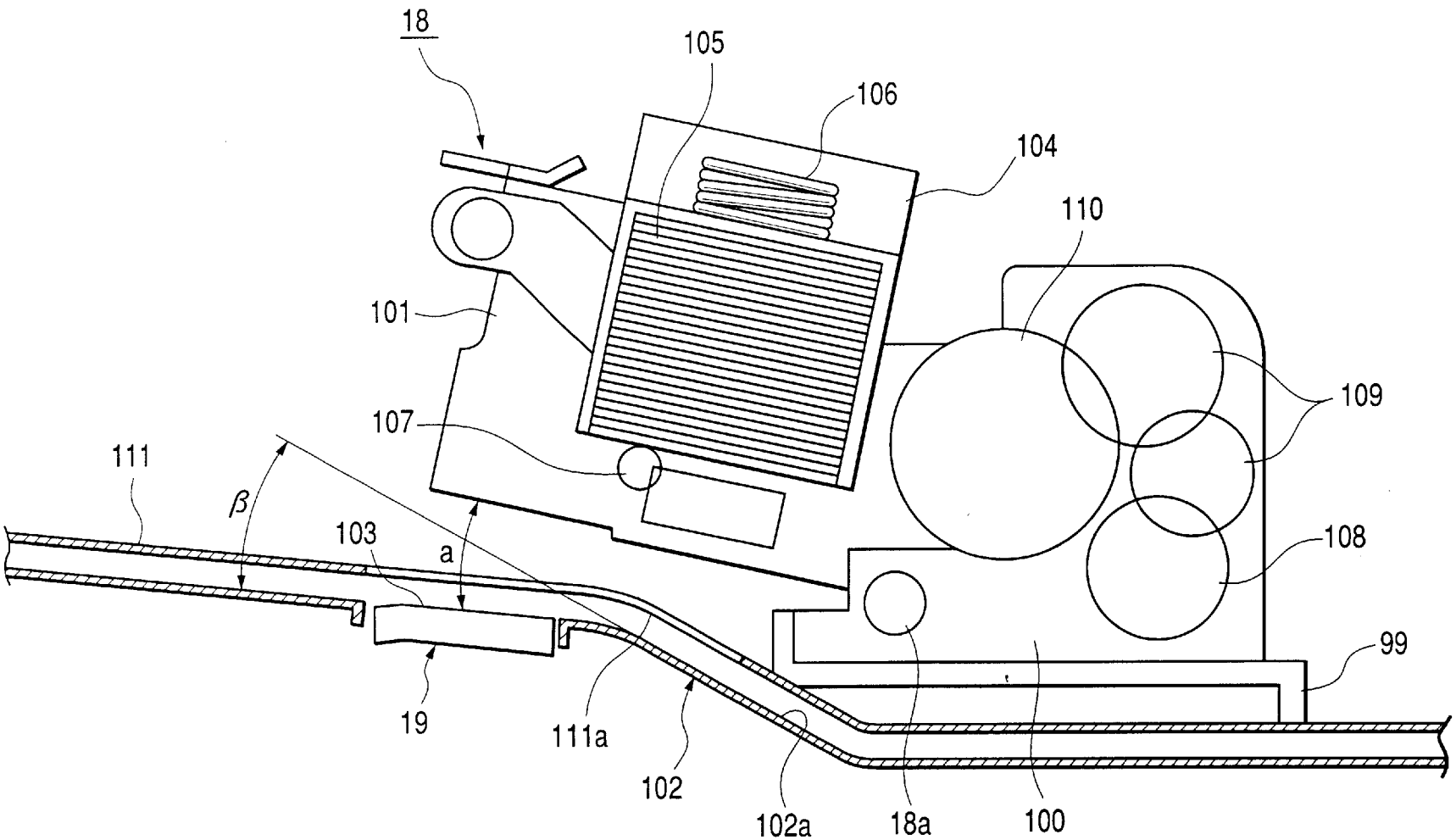
FIG. 5 is a longitudinal cross-sectional view showing the constructions of a staple driving mechanism, etc. in the sheet treating apparatus of FIG. 2.
Figure 6:
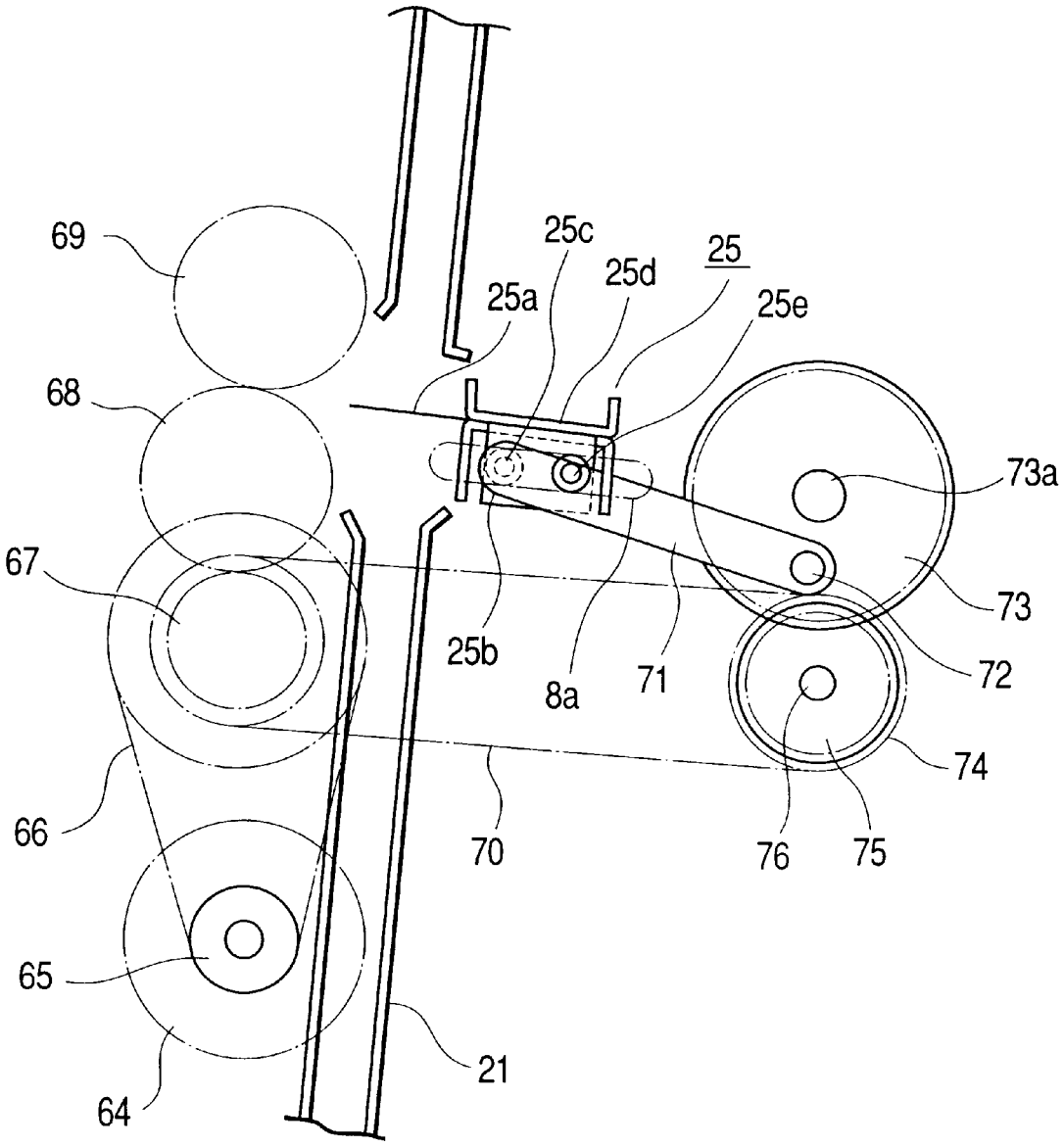
FIG. 6 is a longitudinal cross-sectional view showing the construction of a fold driving mechanism in the sheet treating apparatus of FIG. 2.
Figure 7:
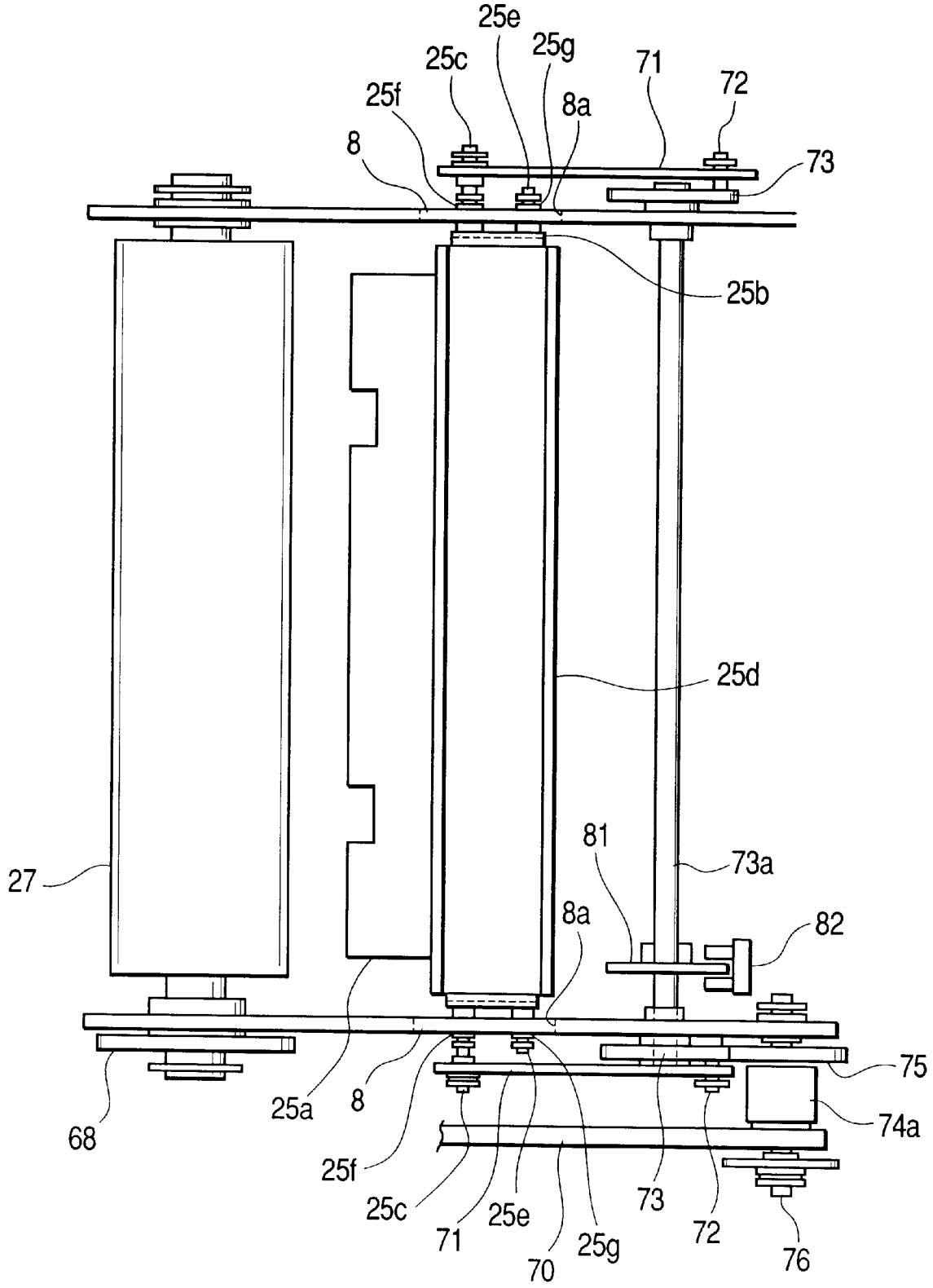
FIG. 7 is a transverse cross-sectional view showing the construction of a sheet bundle folding apparatus in the sheet treating apparatus of FIG. 2.

A staple unit driving mechanism will now be described with reference to FIGS. 4 and 5, etc.

The staple unit 18 is disposed at a bisymmetrical position on a support plate 99 fixed to the frames 8, 8 with respect to the center of the bundle of sheets aligned by the width adjusting members 24*a* and 24*b*.

The staple unit 18 is comprised of a stapling portion (hereinafter referred to as the forming portion) 101 as upper stapling means supported for pivotal movement about a rotary shaft 18*a*, a driving unit 100 and an anvil portion (bending portion) 19.

Below the staple rotary shaft 18*a*, the guide surface 102*a* of a guide member 102 for guiding the bundle of sheets and the binding surface 103 of the anvil portion 19 for staple-binding the guided bundle of sheets are constructed so as to have an angle β therebetween, and a guide 111 for the upper surface of a path portion 102 is formed with a cut-away 111*a* of such a size that does not interfere when the forming portion 101 of the staple unit 18 is pivotally moved.

A staple cartridge 104 is removably mounted on the forming portion 101, and this staple cartridge 104 is loaded with a plurality of binding staples 105 connected together into a plate-like shape.

The plate-like binding staples 105 loading the staple cartridge 104 are downwardly biased by a spring 106 provided on the uppermost side of the staple cartridge 104, and are designed to impact a conveying force to a feed roller 107 disposed on the lowermost side.

The staples 105 fed out by the feed roller 107 are formed into a U-shape one by one by the forming portion 101 being pivotally moved about the rotary shaft 18*a*.

When a staple motor 108 is started, an eccentric cam gear 110 is rotated through a gear train 109. Thus, by the action of an eccentric cam mounted integrally with the eccentric cam gear 110, the forming portion 101 is pivotally moved toward the anvil portion 19 side in a direction indicated by arrow a and effects a clinching operation (staple driving-in operation), and the staples 105 thus driven in are bent by the anvil portion 19 under the bundle of sheets to thereby staple-bind the bundle of sheets.

A flag, not shown, is disposed coaxially with the eccentric cam gear 110, and by the flag being detected by a staple sensor, not shown, whether the staple unit 18 is clinching or has finished clinch (or is before starting clinch) is detected.

[Fold Driving Mechanism]

A fold driving mechanism will now be described with reference to FIGS. 6, 7, 8A and 8B, etc.

A pulley 65 is secured to the output shaft of a folding motor 64. An idler gear pulley 67 is comprised of two rows of pulleys and a gear constructed coaxially therewith, and a timing belt 66 is wound between one row of pulleys thereof and the pulley 65.

Fold gears 68 and 69 are secured to the folding rollers 26 and 27, respectively, and are in meshing engagement with each other. The folding gear 68 is in meshing engagement with the gear portion of the idler gear pulley 67.

Figure 18:
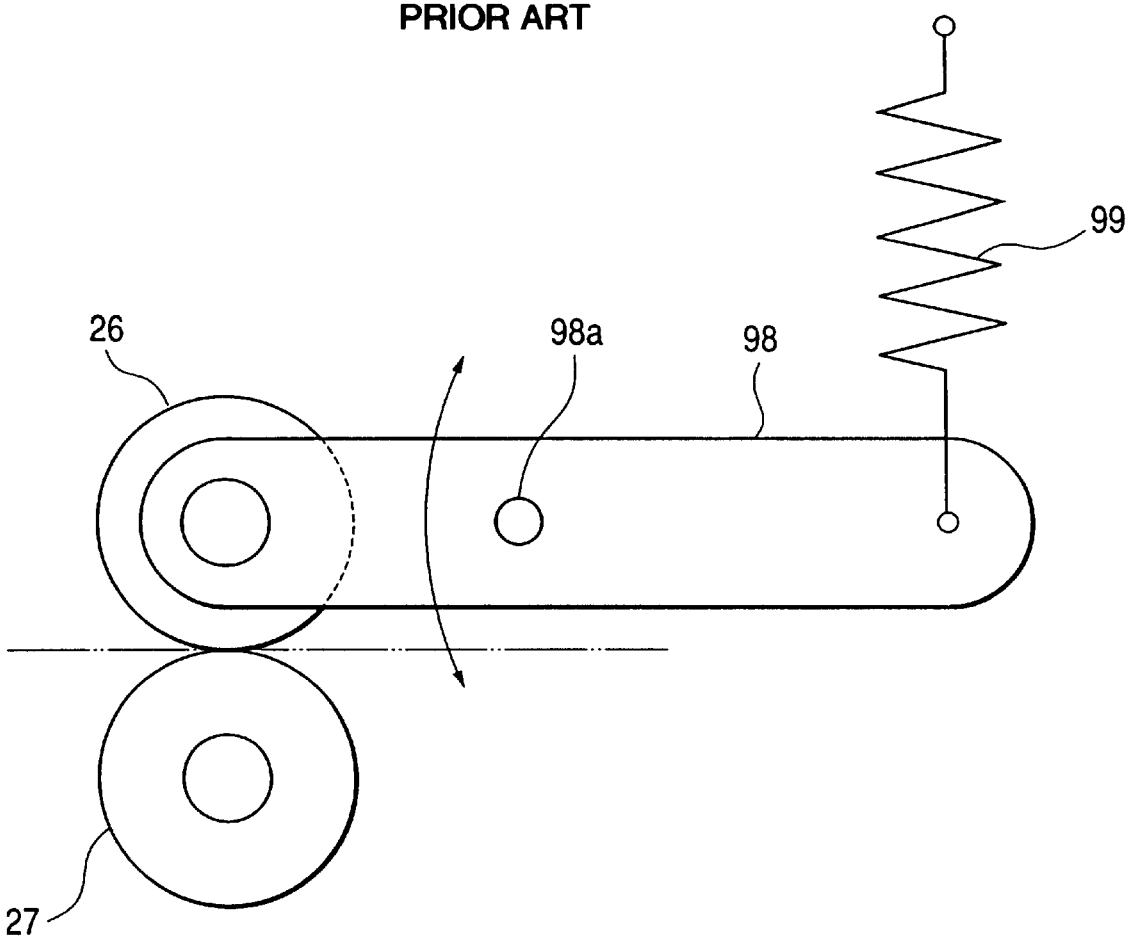
FIG. 18 PRIOR ART
FIG. 18 is a side view showing the construction of the folding roller of a sheet bundle folding apparatus in the sheet treating apparatus of FIG. 17.

The folding roller 26 is mounted on a support plate 98 supported on the frames 8 for pivotal movement about a support shaft 98*a*, and is urged against the folding roller 27 mounted (fixedly positioned) also on the frames 8, by a spring 99 (see FIG. 18). Thereby, the distance between the folding rollers 26 and 27 is changed in conformity with the thickness of the bundle of sheets.

The stick-out plate (sheet bundle push-in member) 25*a* of the stick-out unit 25 is made of a thin and hard material such as stainless steel to direct the bundle of sheets to the nip between the fold rollers 26 and 27, and is held by stick plate holders 25*b* and 25*d*.

Shafts 25*c* and 25*e* are secured to the stick plate holder 25*b*, and rotatable sliding rollers 25*f* and 25*g* are mounted around these shafts.

A gear 73 constitutes a shaft 72 in a portion thereof. An idler gear 75 is in meshing engagement with the gear 73. An electromagnetic clutch (folding clutch) 74*a* is disposed on the shaft 76 of the idler gear 75, and the transmission of the rotation of a pulley 74 on the electromagnetic clutch 74*a* to the shaft 76 is controlled by the ON/OFF of the power source. A timing belt 70 is wound around the pulley 74. One end portion of the timing belt 70 is wound on the pulley portion of the idler gear pulley 67.

A flag 81 having a cut-away on a portion thereof is secured to the shaft 73*a* of the gear 73. A stick-out home sensor 82 is disposed at a position for detecting the cut-away of the flag 81, and the stick-out plate 25*a* is disposed so as to detect it at the most depressed position from the conveying surfaces of the guides 12 and 21.

The rotation of the folding motor 64 is transmitted from the pulley 65 to the idler gear pulley 67 through the timing belt 66. The rotation of the idler gear pulley 67 is transmitted from the folding gear 68 to the folding gear 69, whereby the fold rollers 26 and 27 are driven.

Also, the rotation of the idler gear pulley 67 is transmitted to the pulley 74 on the stick-out clutch 74*a* through the timing belt 70. The rotation of the pulley 74 is transmitted to the shaft 76 by the ON/OFF of the stick-out clutch 74*a*, and the idler gear 75 is rotated. By this rotation, the gear 73 is rotated and the shaft 72 lying at a position off the shaft 73*a* of the gear 73 effects circular motion. The other end of a link 71 fitted to the shaft 72 is fitted to the shaft 25*c*, which is secured to the stick-out unit 25 and further is fitted in the groves 8*a* of the frames 8 with the shaft 25*c* through a roller and therefore, when the gear 73 is rotated, the stick-out unit 25 effects rectilinear motion along the grooves 8*a*.

Figure 8A:
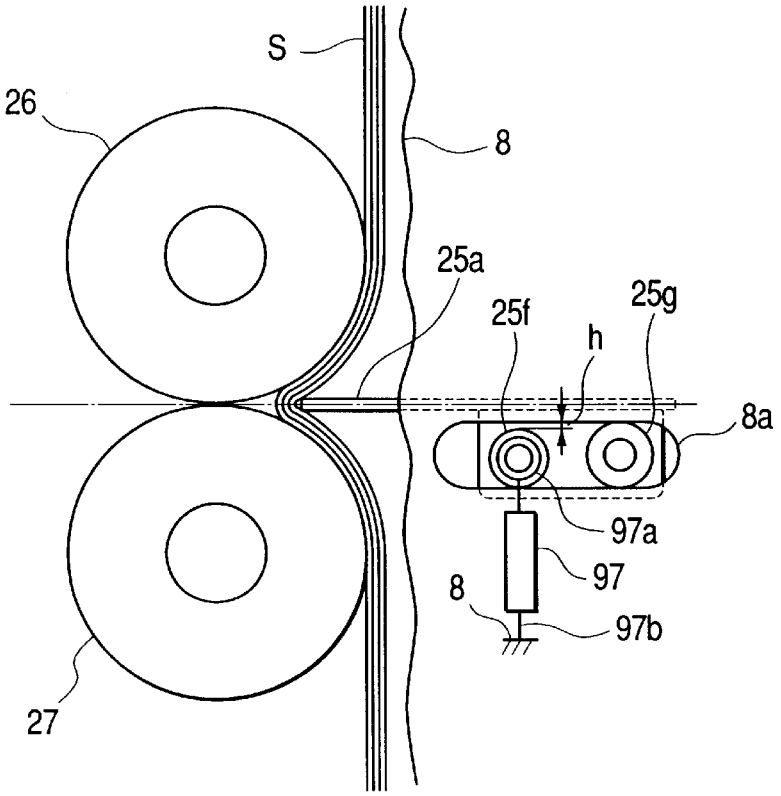
FIGS. 8A and 8B are side views showing the construction of the essential portions (inventive portions) of the sheet bundle folding apparatus (FIG. 7) in the sheet treating apparatus of FIG. 2.
Figure 8B:
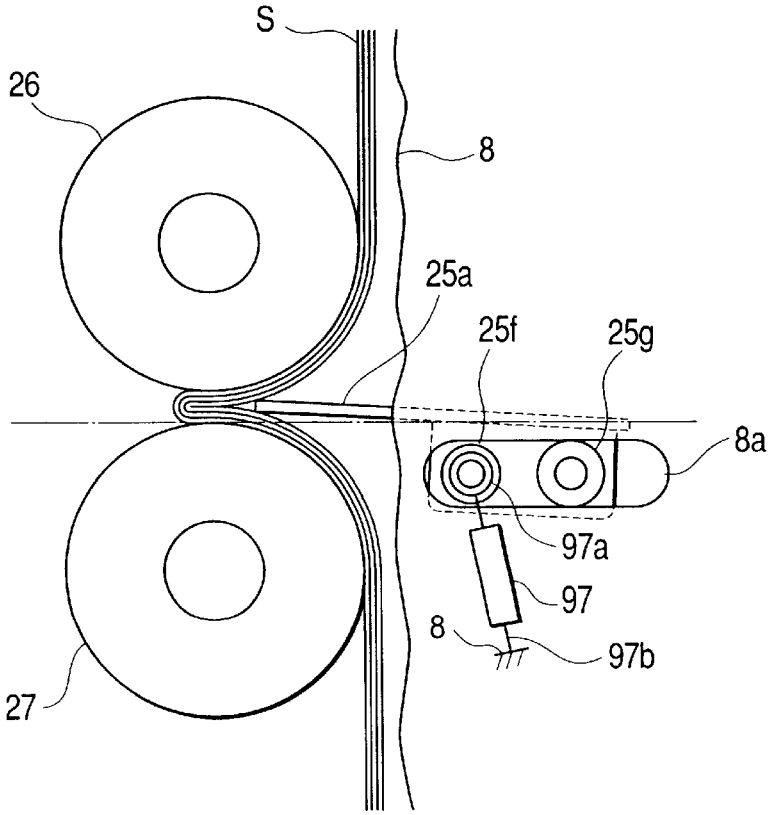

As shown in FIG. 8A, the sliding roller 25*f* of the stick-out unit 25 has a correction allowance h in the upper portion thereof relative to the grooves 8*a* of the frames 8, and slides relative to the grooves 8*a* in the lower portion thereof, and is downwardly biased by a spring 97.

A sliding roller 25*g* has a diameter substantially equal to the width of the groove 8*a*, while the sliding roller 25*g* has a diameter smaller than the width of the groove 8*a*. Thus, the correction allowance h is obtained for the sliding roller 25*f*.

Also, one end 97*a* of the spring 97 is coupled to the shaft portion of the sliding roller 25*f*, and the other end 97*b* of the spring 97 is coupled to the frame 8.

Thus, when during the folding of the bundle of sheets, the stick-out plate 25*a* is guided by the grooves 8*a* when it directs the bundle of sheets S to the nip portion between the two folding rollers 26 and 27, and can accurately stick the nip position between the folding rollers (FIG. 8A). Also, after the bundle of sheets S has been nipped between the folding rollers 26 and 27, the stick-out plate 25*a* follows the folding position for the bundle of sheets S (FIG. 8B) and can reliably stick the folding position for the bundle of sheets S. Therefore, folding can be effected without causing wrinkles or breakage.

[Discharge Roller Portion Driving Mechanism]

A pulley 30*b* is secured to the central shaft 30*a* of the discharge roller 30. The reference numeral 91 designates a discharge motor, to the output shaft of which is secured a pulley 92. A timing belt 93 is wound on the pulley 92 and the pulley 30*b*, and the rotation of the discharge motor 91 is transmitted from the pulley 92 to the pulley 30*b* through the timing belt 93 to thereby drive the discharge roller 30.

The discharge motor 91 is comprised of a stepping motor, and the peripheral speed of the discharge roller 30 is higher than the peripheral speed of the folding rollers 26 and 27.

The conveying force of the folding rollers 26 and 27 is greater than conveying force of the pair of discharge rollers 30 and 31 and therefore, when the bundle of sheets is being nipped between and conveyed by the folding rollers 26 and 27, slip is caused, and when the bundle of sheets passes between the folding rollers 26 and 27, the bundle of sheets is conveyed by the conveying force of the pair of discharge rollers 30 and 31.

[Stacker Discharge Portion Driving Mechanism]

A pulley 98 is secured to the shaft 5*a* of the stacker discharge roller 5. The reference numeral 95 denotes a stacker discharge motor, to the output shaft of which is secured a pulley 96. A timing belt 97 is wound on the pulley 96 and the pulley 98.

The rotation of the stacker discharge motor 95 is transmitted from the pulley 96 to the pulley 98 through the timing belt 97 to thereby drive the stacker discharge roller 5.

The stacker discharge motor 95 is comprised of a stepping motor, and the peripheral speed of the stacker discharge roller 5 is higher than the peripheral speed of a pair of discharge rollers 905.

The conveying force of the discharge rollers 905 is greater than the conveying force of the pair of stacker discharge rollers 5 and 6 and therefore, as long as the bundle of sheets is nipped between and conveyed by the pair of discharge rollers 905, slip is caused between the pair of stacker discharge rollers 5 and 6, and when the bundle of sheets passes between the pair of discharge rollers 905, the bundle of sheets is conveyed by the conveying force of the pair of stacker discharge rollers 5 and 6.

[Control Sequence]

Figure 9:
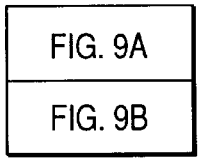
FIG. 9, which is comprised of FIGS. 9A and 9B, is a flow chart showing the control sequence (main routine) of an MPU in the sheet treating apparatus of FIG. 2.
Figure 9A:
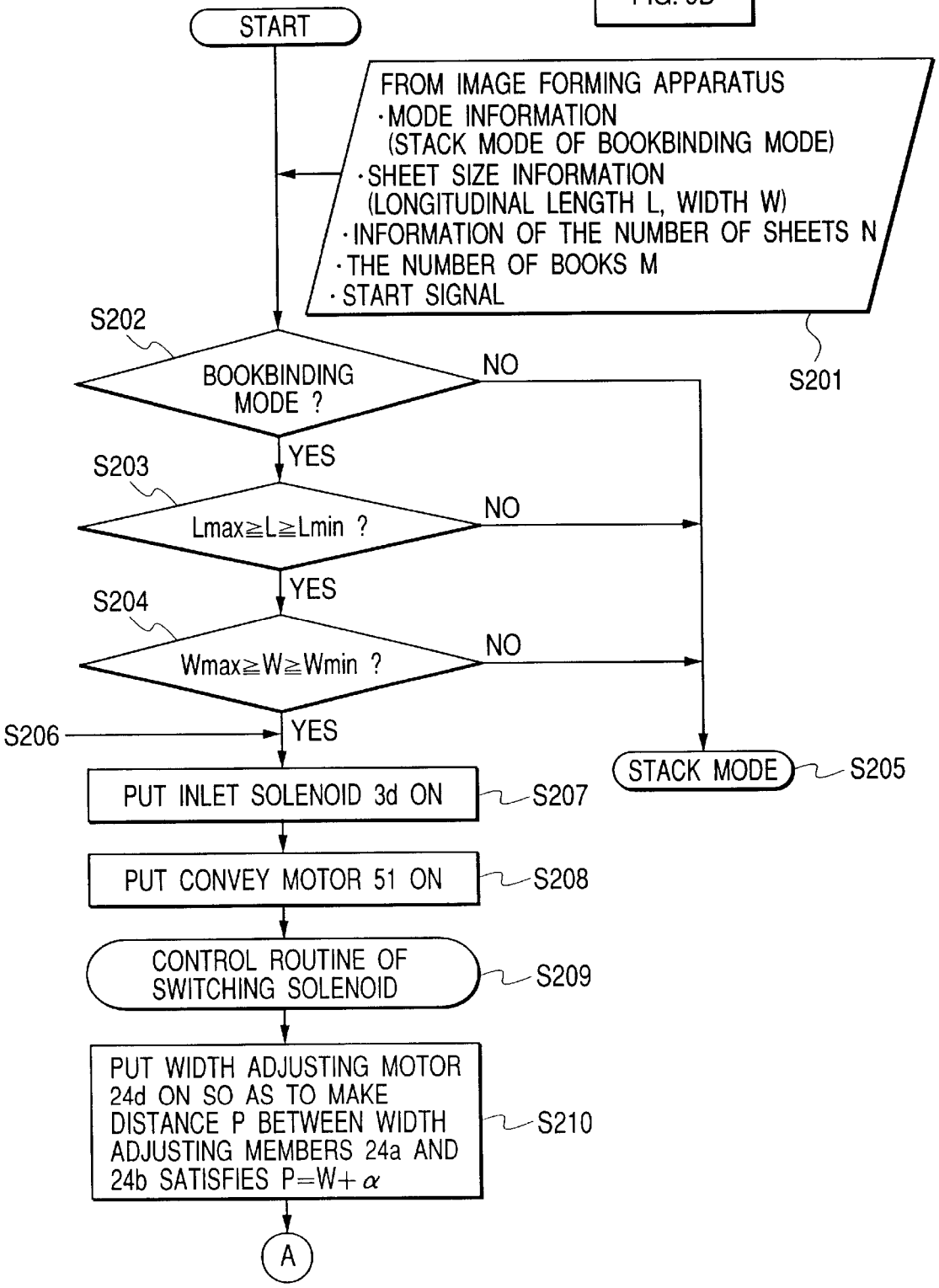
Figure 9B:
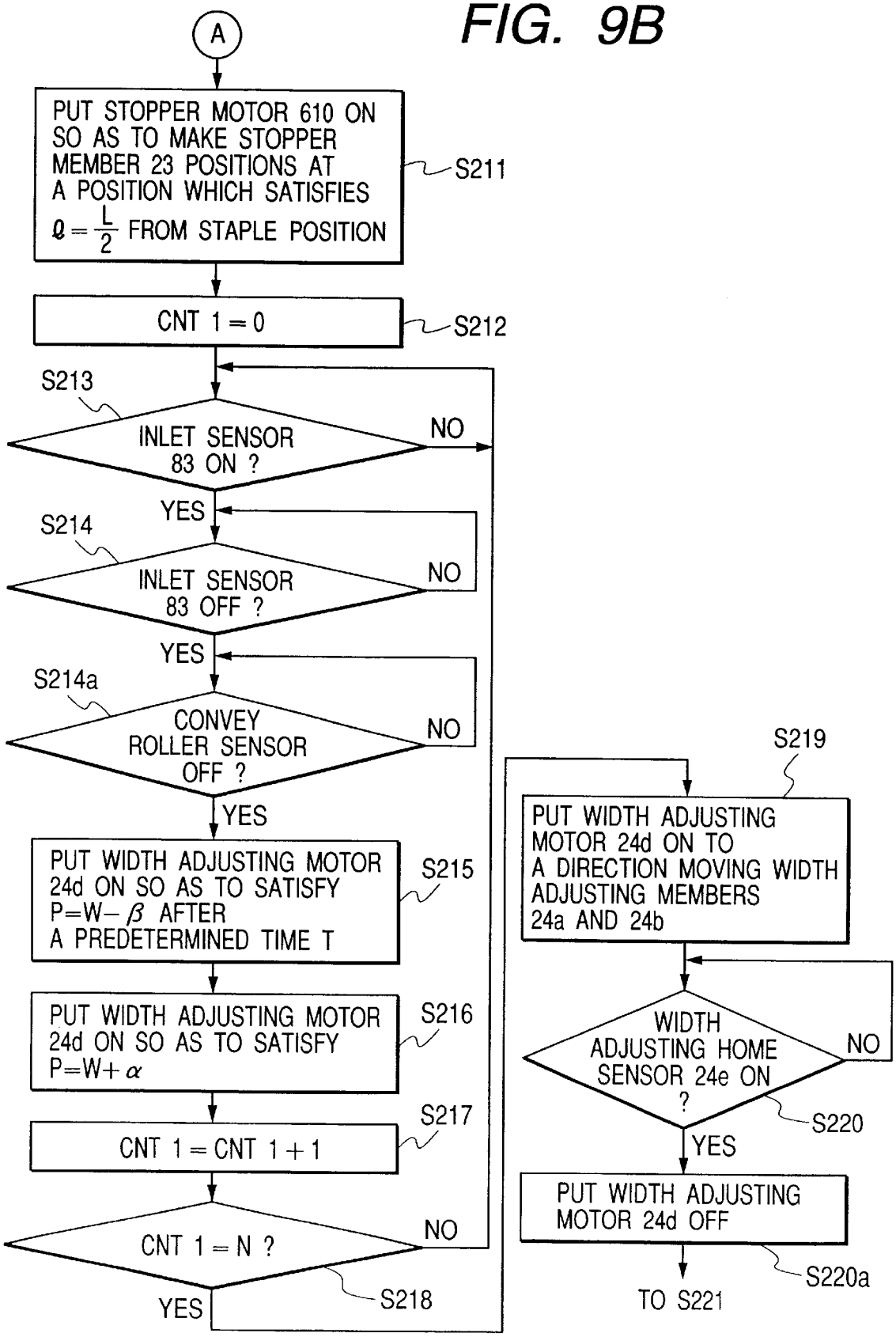
Figures 10, 10A:
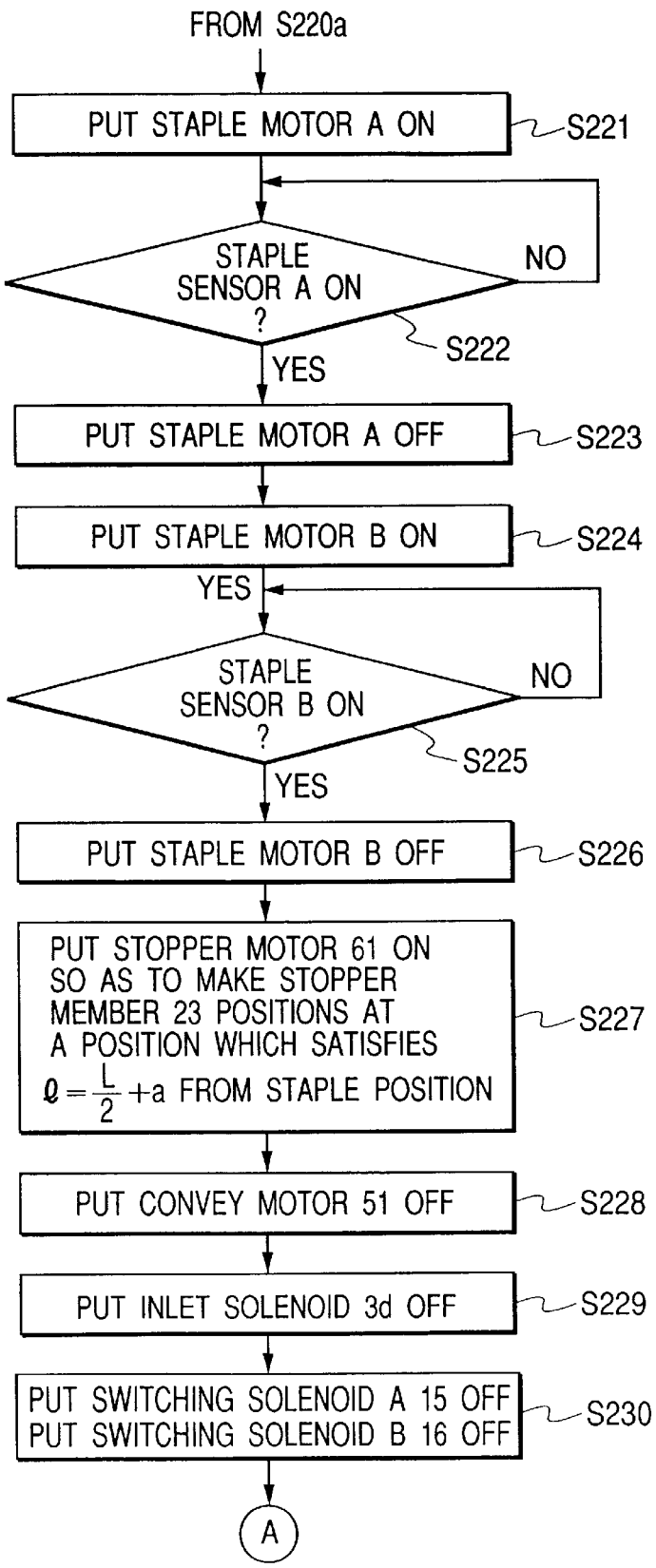
FIG. 10, which is comprised of FIGS. 10A and 10B, is a flow chart showing the control sequence (the main routine continued from FIGS. 9A and 9B) of the MPU in the sheet treating apparatus of FIG. 2.
Figure 10B:
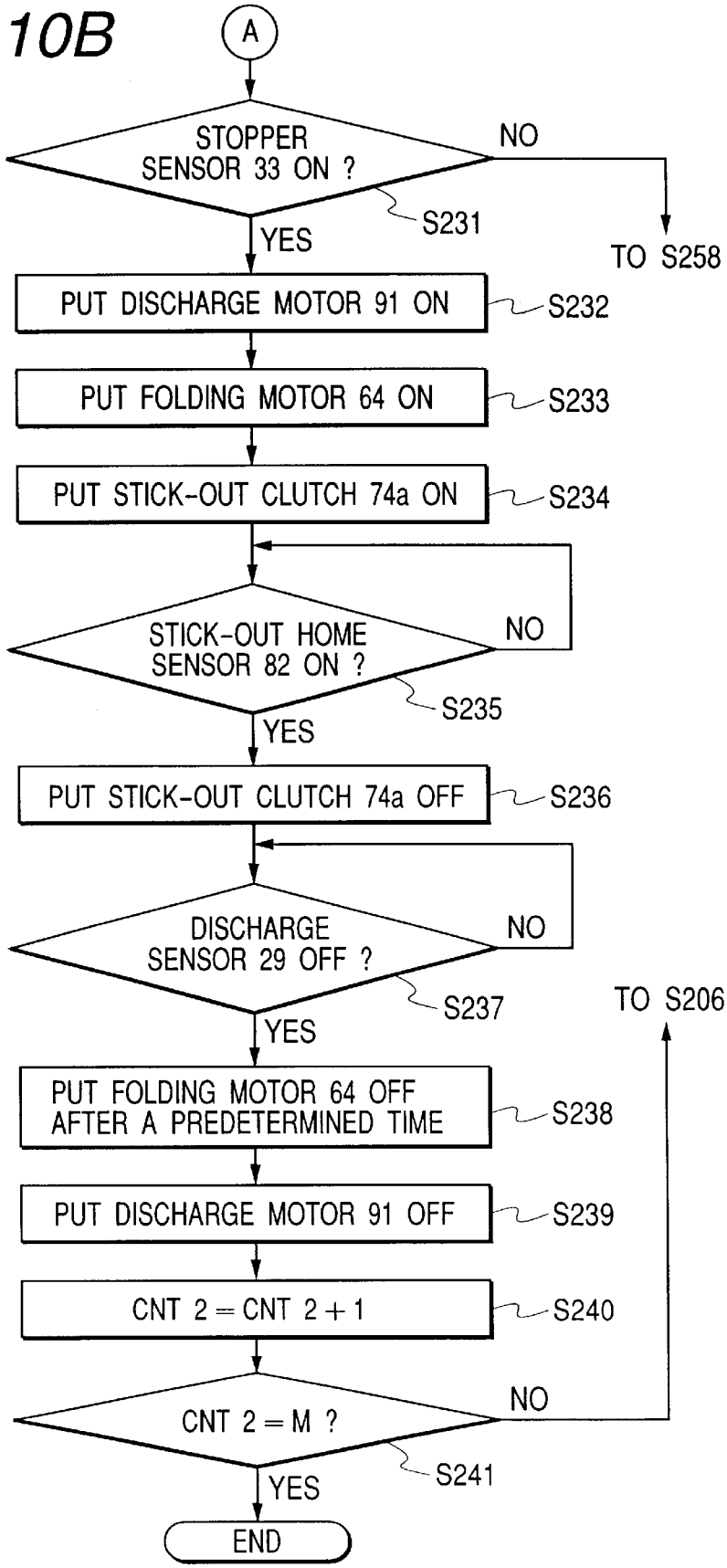
Figure 12:
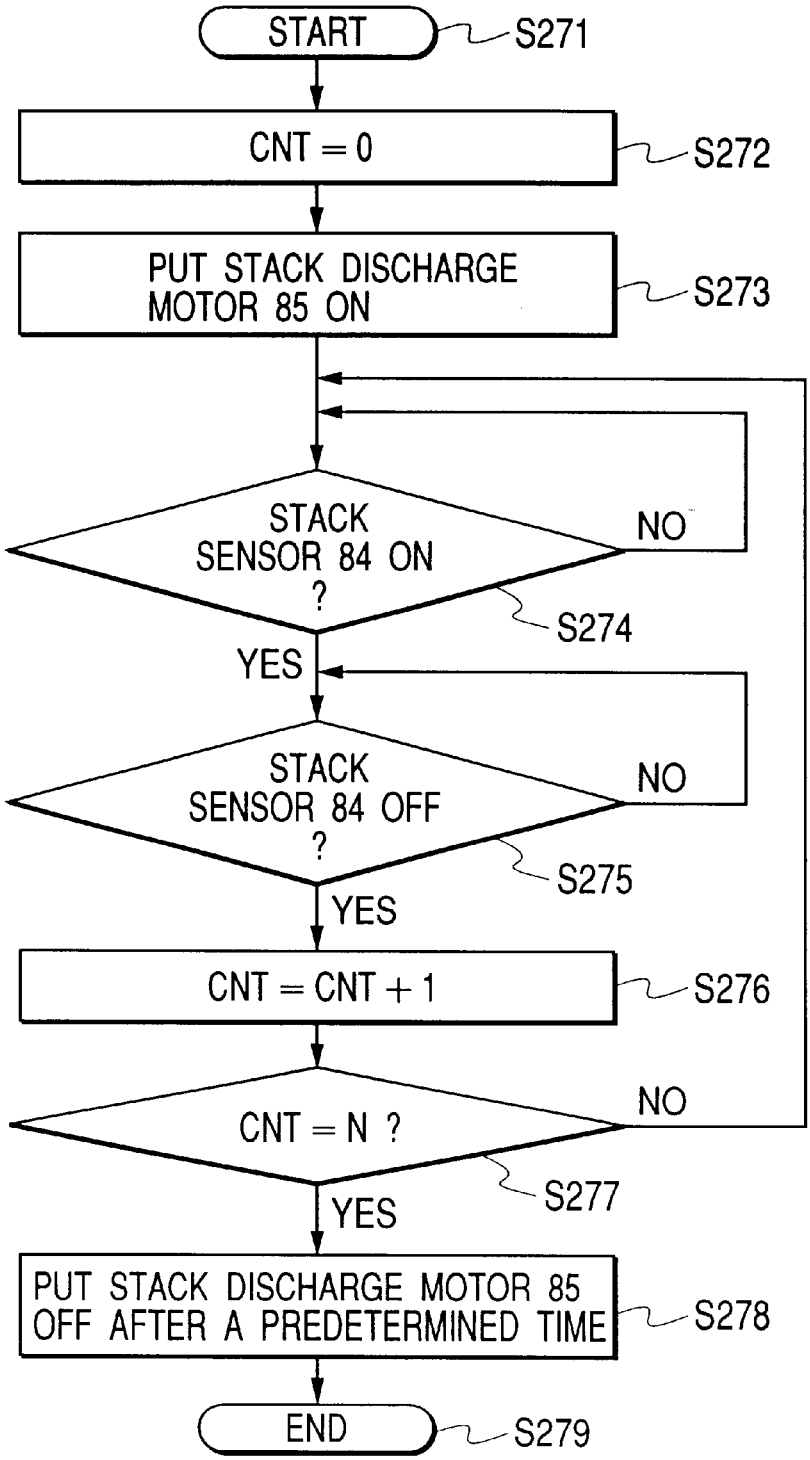
FIG. 12 is a flow chart showing the control sequence (stack mode routine) of the MPU in the sheet treating apparatus of FIG. 2.
Figure 13:
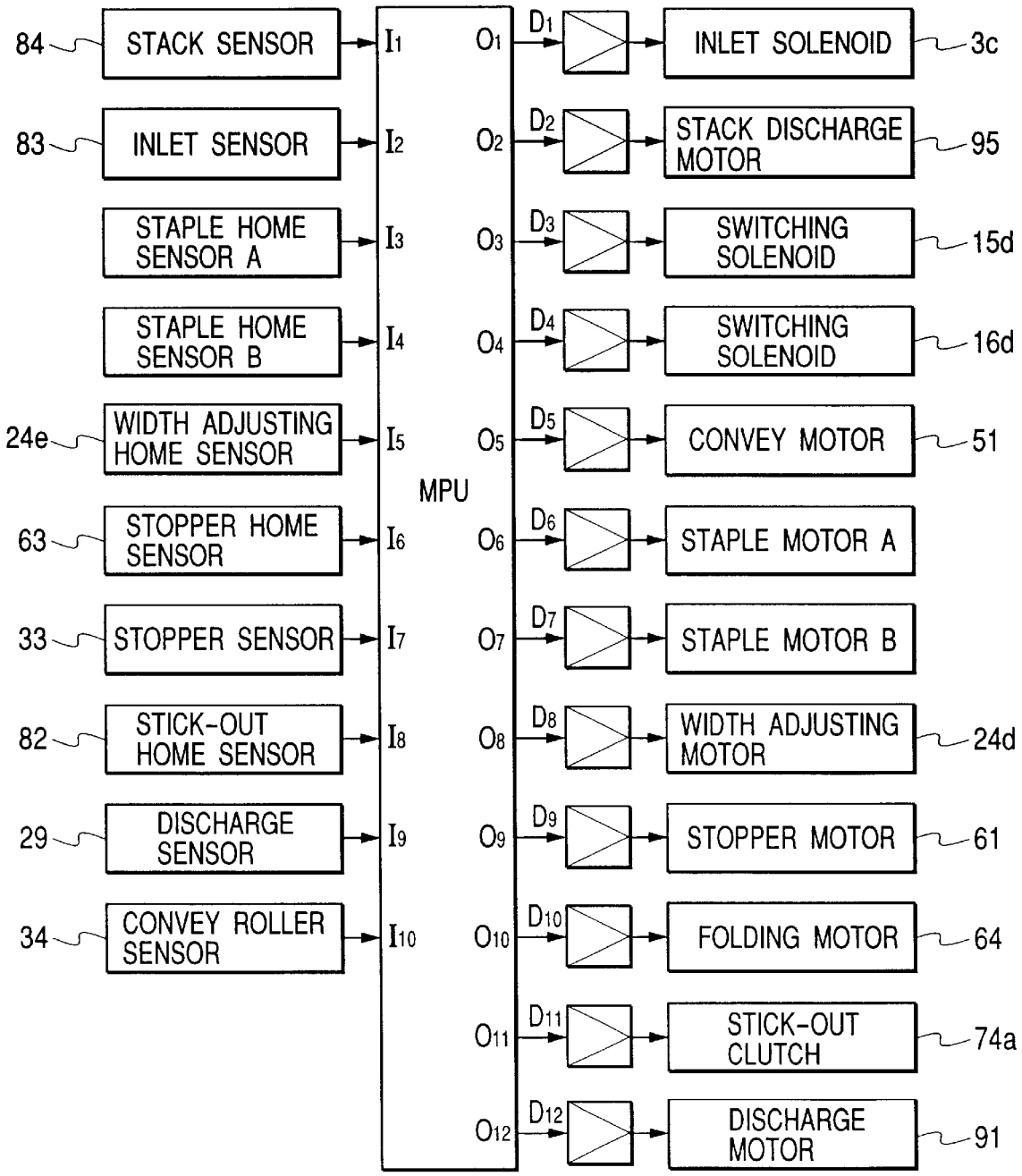
FIG. 13 is an electrical block diagram showing the construction of a control system in the sheet treating apparatus of FIG. 2.

FIGS. 9A and 9B or 12 show the control sequence of MPU 170 in the sheet treating apparatus 2.

FIGS. 9A, 9B, 10A and 10B show the main routine. FIGS. 2 to 6, 13, 14, etc. should be referred to for this description.

When mode information as to the bookbinding mode or the stack mode, the size information of the longitudinal length L and width W of the sheet, the information N of the number of sheets and the information M of the number of books have been received and a start signal is received from the image forming apparatus 900, the operation is started (S201).

The mode is confirmed (S202) and if it is not the bookbinding mode, advance is made to the subroutine of the stack mode (S205). If the mode is the bookbinding mode, whether the length L is between Lmax and Lmin which can be treated by the present apparatus 2 is confirmed (S203), and when the length L is outside the range, stack mode processing is effected (S205).

Subsequently, whether the width W is between Wmax and Wmin which can be treated by the present apparatus 2 is checked (S204), and when the width W is outside the range, the stack mode (S205) is adopted. If the width W is within the range, the inlet solenoid 3*d* is put ON and the path to the bookbinding mode is opened (S207). Subsequently, the convey motor 51 is put ON to thereby rotate the rollers (S208).

Subsequently, advance is made to the switching solenoid control routine to control the switching solenoids 15*d* and 16*d* (S209).

Subsequently, the number of steps for which the distance P between the width adjusting members 24*a* and 24*b* satisfies $P=W+\alpha$ (where $\alpha$ is the gap between the bundle of sheets and the dashing portion of the width adjusting members) is sent to the width adjusting motor 24*d* to rotate it (S210).

Subsequently, the number of steps by which the stopper member 23 is moved to a position which satisfies $l=L/2$ downstream from the staple point 19*a* of the staple unit is sent to the stopper motor 61 to rotate it (S211).

Subsequently, a sheet number counter CNT1 is set to 0 (S212) and the signal of the inlet sensor 83 is confirmed (S213).

If the signal of the inlet sensor 83 is ON, when it has become OFF (S214), after a time t1 until the leading end edge of the bundle of sheet strikes against the stopper 23, the number of steps by which the width adjusting members 24*a* and 24*b* are moved to a position which satisfies $P=W-\beta$ ($\beta$ is the amount by which the width adjusting members 24*a* and 24*b* such in the sheet) is sent to rotate the width adjusting motor 24*d* (S215).

Subsequently, the number of steps corresponding to the movement of the width adjusting members 24*a* and 24*b* to a position which satisfies $P=W+\alpha$ is sent to the width adjusting motor 24*d* (S216).

Subsequently, the sheet number counter CNT1 is advanced by 1 (S217).

Subsequently, whether the sheet number counter CNT1 has reached a desired number of sheets N is confirmed (S218), and if it does not reach the desired number of sheets N, return is made to S213, where the sheet sent from the image forming apparatus 900 is treated in the same manner. If the sheet number counter CNT1 has reached the desired number of sheets N, the width adjusting motor 24*d* is rotated in a direction for moving the width adjusting members 24*a* and 24*b* toward the outside (S219), and this rotation is continued until the width adjusting home sensor 24*e* becomes ON (S220). When the width adjusting home sensor 24*e* has become ON, the width adjusting motor 24*d* is put OFF (S220*a*).

Next, the stapling of the bundle of sheets is effected and first, the stapling is started by one of the two staple units 18A and 18B.

A staple motor 108A is put ON (S221) and when a staple sensor A has detected it (S222), the staple motor 108A is put OFF (S223). Thereafter, the staple unit 18B is also made to perform a similar operation (S224, S225 and S226), thus completing the stapling work.

Subsequently, the stopper motor 61 is rotated by a number of steps for which the stopper member 23 satisfies $l=(L/2)+c$ on the downstream side from the staple position 19*a* (S227). Here, c is the distance between the staple position 19*a* and the folding position. At this time, the center of the bundle of sheets (the position at which the bundle has been stapled) is on a line linking the nip position between the folding rollers 26 and 27 and the center of the stick-out plate 25*a* together.

Subsequently, the convey motor 51, the inlet solenoid 3*c* and the switching solenoids 15 and 16 are put OFF to prepare for entering the folding operation (S228 to S230).

Subsequently, it is confirmed that the stopper sensor 33 is ON (S231), the discharge motor 91 is put ON (S232), and the folding motor 64 is put ON (S233).

Subsequently, the stick-out clutch 74*a* is put ON (S234). Thus, the stick-out plate 25*a* begins to stick out and guides the bundle of sheets to between the folding rollers 26 and 27.

Subsequently, it is confirmed that the stick-out home sensor 82 becomes ON (S235), and when it has become ON, the stick-out clutch 74*a* is put OFF (S236).

Subsequently, it is confirmed that the discharge sensor 29 becomes OFF (S237), and when it has become OFF, a timer is started and it is confirmed by the timer that a time sufficient for the trailing end edge of the bundle of sheets to pass the pair of discharge rollers 30 and 31 has elapsed, whereafter the folding motor 64 is put OFF (S238) and the discharge motor 91 is put OFF (S239). Here, immediately after the discharge sensor 29 has become OFF, the discharge motor is slowed down so that the trailing end edge of the bundle of sheets may pass between the discharge rollers at a low speed.

Subsequently, a book number counter CNT2 is advanced by 1 (S240), and if the book number counter CNT2 has not reached a desired number of books M (S241), return is made to S206, and if the book number counter CNT2 has reached the desired number of books M, the work is ended (S242).

Figure 11:
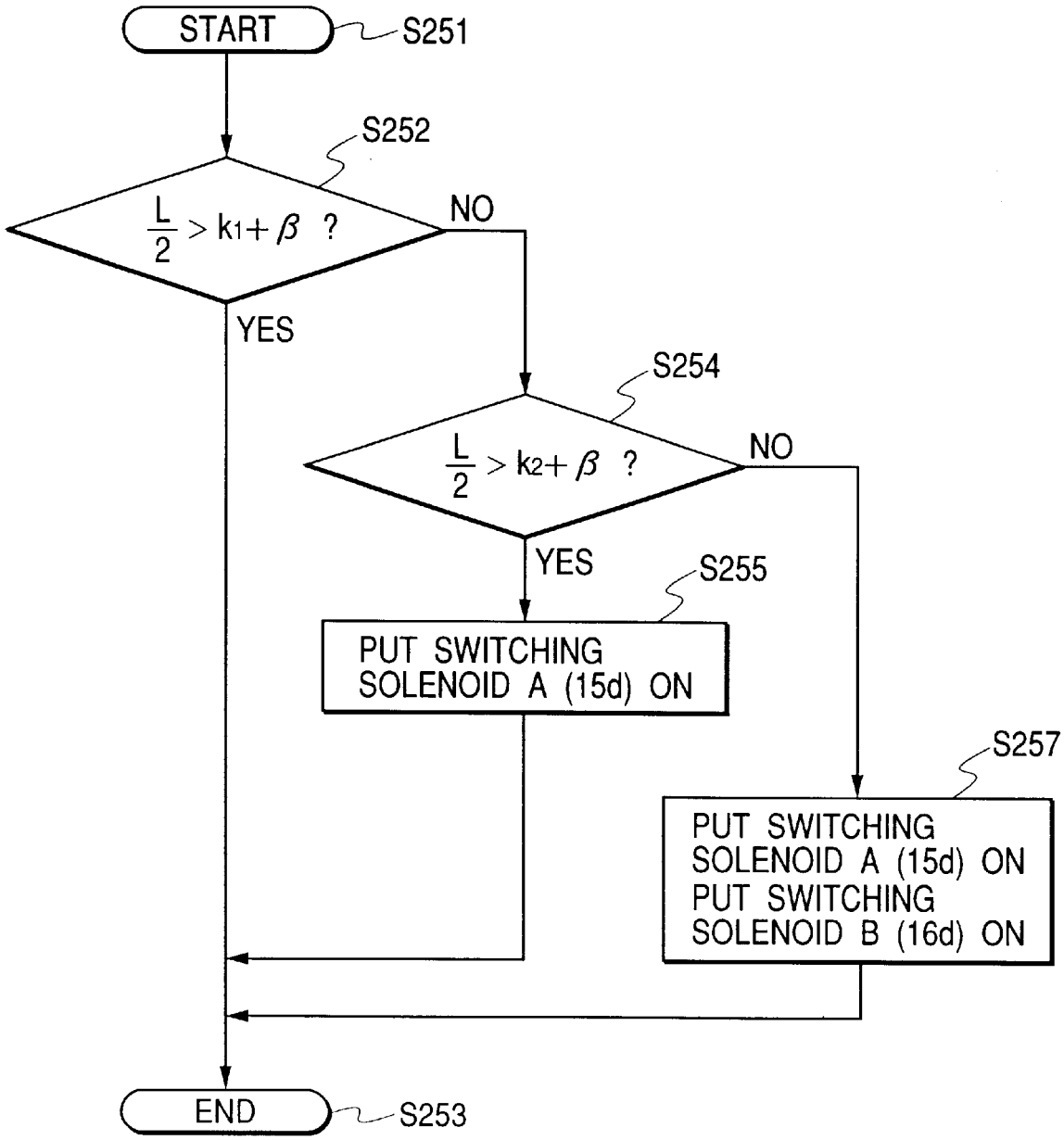
FIG. 11 is a flow chart showing the control sequence (switching solenoid control routine) of the MPU in the sheet treating apparatus of FIG. 2.
Figure 14:
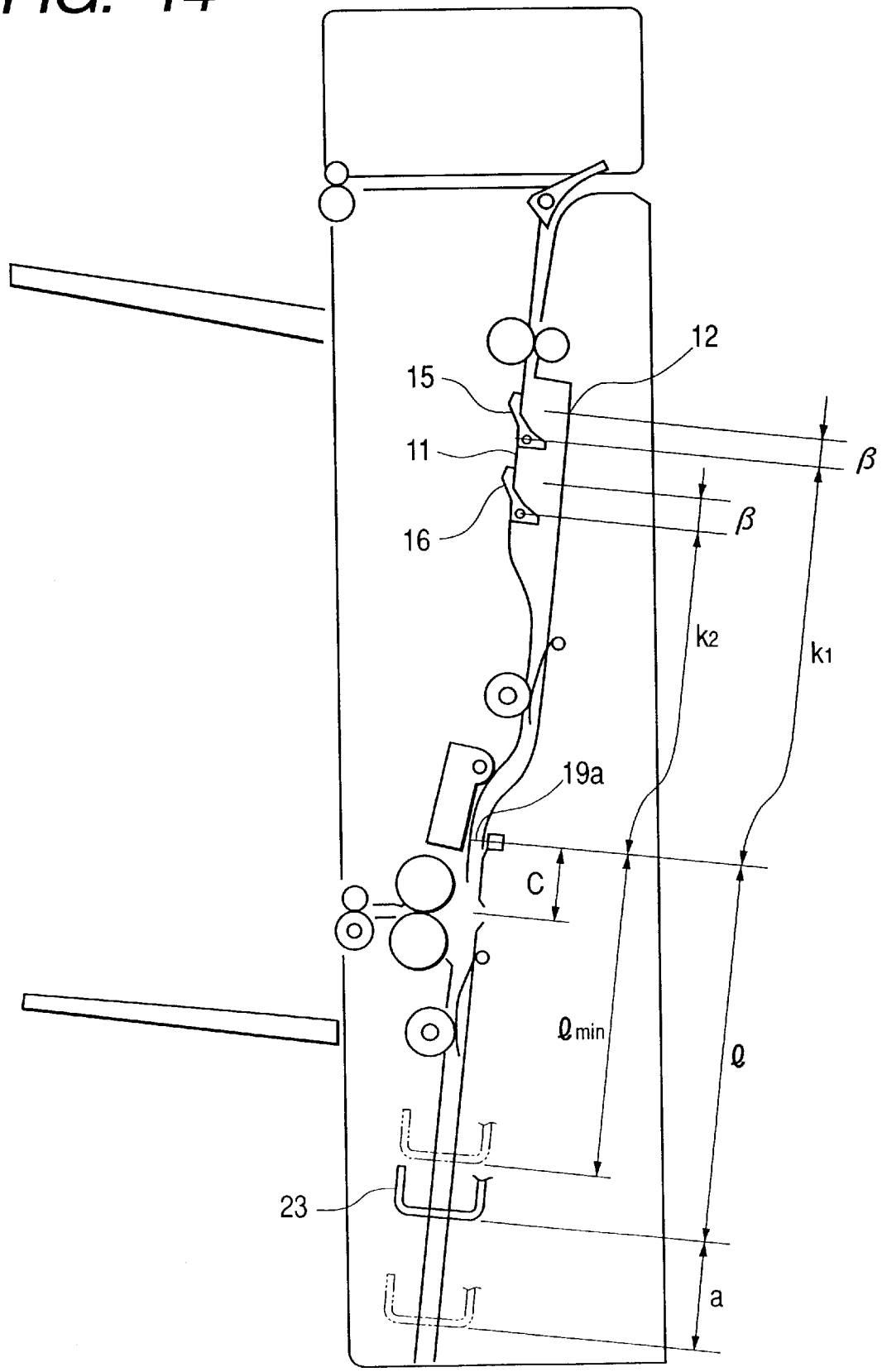
FIG. 14 is a side view showing the positional relations among main portions in the sheet treating apparatus of FIG. 2.

FIG. 11 shows a switching solenoid control routine at S209. FIG. 14, etc. should be referred to for this description.

First, whether a half of the sheet size, i.e., L/2, is greater than the sum (K1+β) of the length K1 to the switching flapper 15 along the guides 11 and 12 and a constant β is checked (S252). If it is greater, the switching solenoids 15*d* and 16*d* are kept OFF, and this routine is ended (S253). The constant β shows the position of the trailing end edge of the bundle of sheets stacked when the stopper 23 is at a proper position. This constant β is an amount necessary for the next sheet which has come onto the stacked bundle of sheets to be stacked at the uppermost level without coming into the stacked bundle of sheets.

When L/2 is smaller than (K1+β), L/2 is compared with (K2+β)(S254). Here, K2, like K1, is the distance to the switching flapper 16 along the guides 11 and 12. β is a length similar to that described previously.

If L/2 is greater than (K2+β), the switching solenoid 15*d* is put ON (S255), and the bundle of sheets is guided by the switching flapper 15. If L/2 is smaller than (K2+β), the switching solenoids 15*d* and 16*d* are both put ON (S257) and the bundle of sheets is guided by the switching flappers 15 and 16. Thus, this routine is ended (S253).

FIG. 12 shows a stack mode routine at S205.

First, a sheet number counter CNT is set to 0 (S272).

Subsequently, the stack discharge motor 85 is put ON (S273) to rotate the stack discharge roller 5.

Subsequently, whether the stack sensor 84 is ON is checked (S274), and if it is ON, it is waited for the stack sensor 84 to become OFF (S275), and if it has become OFF, 1 is added to the sheet number counter CNT (S276), and whether the sheet number counter CNT has coincided with the number of sheets N is checked (S277), and if the sheet number counter CNT is smaller than N, return is made to S274.

Subsequently, when the sheet number counter CNT has reached the number of sheets N, the stack discharge motor 85 is put OFF after the lapse of a time sufficient for the trailing end edge of the bundle of sheets to pass the stack sensor 84 (S278). Thus, this routine is ended (S279).

Second Embodiment

Figure 15:
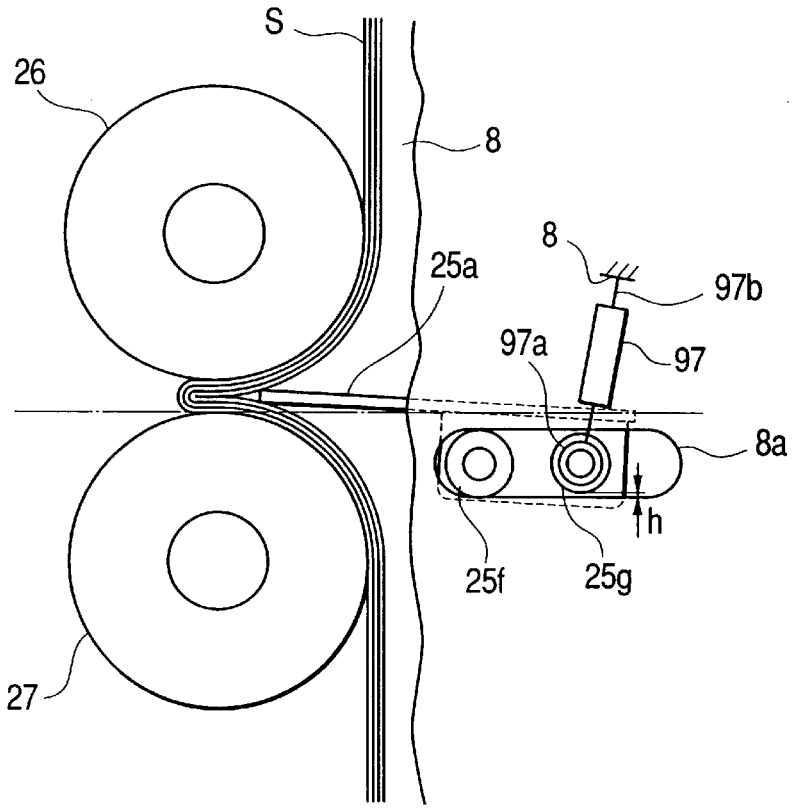
FIG. 15 is a side view showing another example of the construction of the sheet bundle folding apparatus.

FIG. 15 shows another example of the construction of the sheet bundle folding apparatus.

While in the first embodiment, in a construction wherein the upper folding roller 26 separates from the lower folding roller 27, a correction allowance h is provided above the forward sliding roller 25, here a correction allowance h is provided below the rearward sliding roller 25*g*.

Third Embodiment

Figure 16:
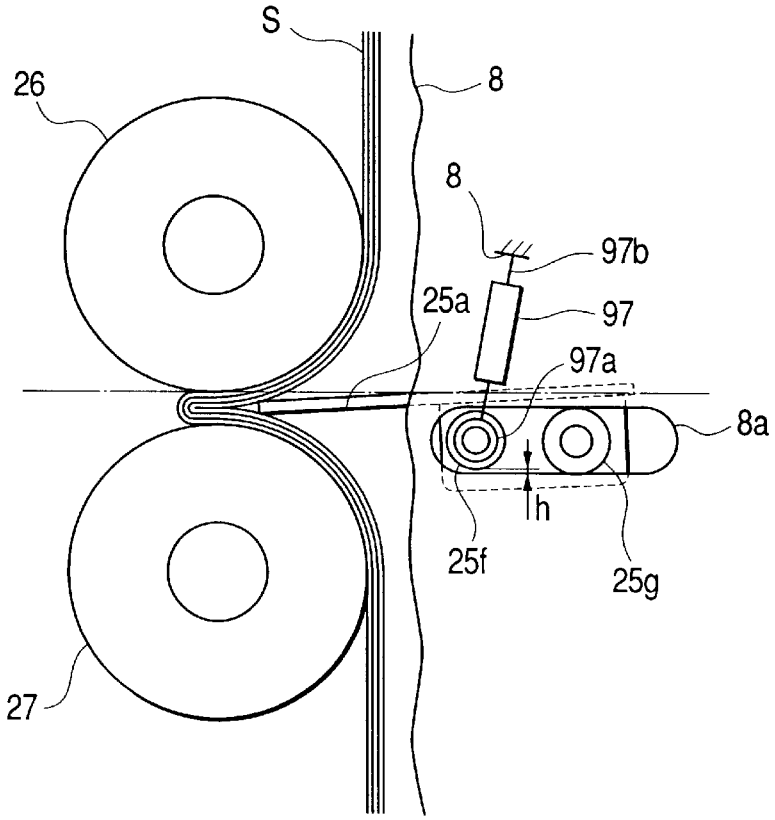
FIG. 16 is a side view showing still another example of the construction of the sheet bundle folding apparatus.
Figure 17:
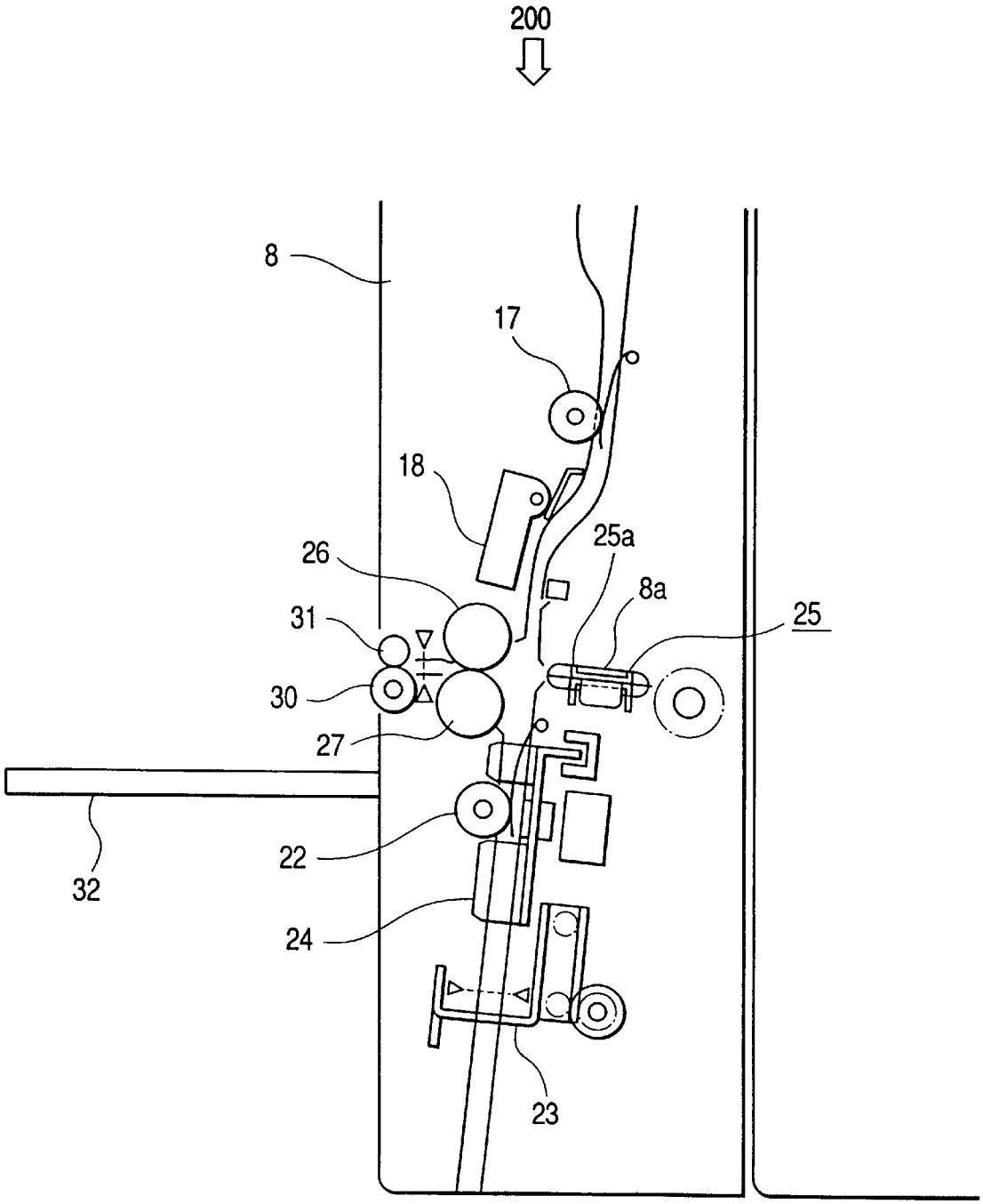
FIG. 17 PRIOR ART
FIG. 17 is a longitudinal cross-sectional view showing the construction of a sheet treating apparatus according to the prior art.

FIG. 16 shows still another example of the construction of the sheet bundle folding apparatus.

While the first embodiment is of a construction in which the upper folding roller 26 separates from the lower folding roller 27, this embodiment is of a construction in which the lower folding roller 27 separates from the upper folding roller 26, and a correction allowance h is provided below the forward sliding roller 25*f*.

Of course, the correction allowance h may be provided for both of the forward and rearward sliding rollers 25*f* and 25*g*.

As described above, according to the sheet bundle folding apparatus of the present invention, the sheet bundle push-in member is designed to follow the folding position for the bundle of sheets pushed into between the fixed folding member and the movable folding member by the sheet bundle push-in member and therefore, the sheet bundle push-in member can reliably stick the bundle of sheets at the folding position therefore. Thus, no wrinkle or breakage is caused in the folded bundle of sheets.

What is claimed is:

1. A sheet bundle folding apparatus comprising:

fixed folding member positionally fixed at a predetermined position;

a movable folding member separably contactable with said fixed folding member; and a sheet bundle push-in member movable toward an area between said fixed folding member and said movable folding member to push a bundle of sheet into the area between said fixed folding member and said movable folding member;

wherein said sheet bundle push-in member is capable of moving in a sheet folding direction along a guide groove via a sliding member, wherein said sheet bundle push-in member is capable of moving also in a retracting direction of said movable folding member by providing an allowance between said sliding member and said guide groove, wherein said sheet bundle push-in member follows a folding position of the bundle of sheet pushed into an area between said fixed folding member and said movable folding member by said sheet bundle push-in member, and wherein said sliding member includes two members provided along the sheet folding direction, and wherein one member of said two members has a width smaller than a width of said guide groove and the other member has a width substantially equal to the width of said guide groove.

2. A sheet bundle folding apparatus according to claim 1, wherein a biasing member is provided on said member having the width smaller than the width of said guide groove.

3. A sheet bundle folding apparatus according to any one of claims 1 and 2, wherein said sliding member is a roller.

4. A sheet bundle folding apparatus comprising:

a pair of rollers for folding a bundle of sheets in two by nipping the bundle of sheets therebetween, one of said pair of rollers being rotatably supported at a predetermined position, the other rollers being supported to contact separably with said one roller;

a sheet bundle push-in member movable toward between said pair of rollers to push the bundle of sheets into between said pair of rollers;

wherein said sheet bundle push-in member is constituted movably and rockably by being engaged with a guide groove provided on a guide member, with an allowance, wherein a tip end portion of said sheet bundle push-in member follows a folding position by pivoting in conformity with a displacement of the folding position of the bundle of sheets, wherein said sheet bundle push-in member is engaged with said guide groove via a sliding member, and the allowance is provided between said sliding member and said guide groove, and wherein said sliding member includes two members provided along the sheet folding direction, and wherein one member of said two members has a width smaller than a width of said guide groove and the other member has a width substantially equal to the width of said guide groove.

5. A sheet bundle folding apparatus according to claim 4, wherein a biasing member is provided on said member having the width smaller than the width of said guide groove.

6. A sheet bundle folding apparatus according to any one of claims 4 and 5, wherein said sliding member is a roller.

* * * * *

UNITED STATES PATENT AND TRADEMARK OFFICE

CERTIFICATE OF CORRECTION

PATENT NO. : 6,276,677 B1
DATED : August 21, 2001
INVENTOR(S) : Hiroki Hommochi et al.

It is certified that error appears in the above-identified patent and that said Letters Patent is hereby corrected as shown below:

Column 1,
Line 67, "therefor" should read -- thereof --.

Column 2,
Line 22, "accurately" should read -- accurately position --.
Line 62, "constructions" should read -- construction --.

Column 3,
Line 58, "907" should read -- 907, --.

Column 12,
Line 16, "therefore" should read -- thereof --.

Signed and Sealed this

Fifth Day of March, 2002

*Attest:*

*Attesting Officer*

JAMES E. ROGAN
*Director of the United States Patent and Trademark Office*